US006592085B2

(12) United States Patent
Iwata et al.

(10) Patent No.: US 6,592,085 B2
(45) Date of Patent: Jul. 15, 2003

(54) ARMREST APPARATUS

(75) Inventors: Koichi Iwata, 25, Suganuma, Oyama-Cho, Sunto-Gun, Shizuoka 410-1312 (JP); Hiroshi Saito, Matsudo (JP)

(73) Assignees: Koichi Iwata (JP); Kabushiki Kaisha Tsuden (JP)

( * ) Notice: Subject to any disclaimer, the term of this patent is extended or adjusted under 35 U.S.C. 154(b) by 0 days.

(21) Appl. No.: 09/753,780

(22) Filed: Jan. 3, 2001

(65) Prior Publication Data

US 2001/0022334 A1 Sep. 20, 2001

(30) Foreign Application Priority Data

| | | |
|---|---|---|
| Jan. 7, 2000 | (JP) | 2000-001324 |
| Apr. 6, 2000 | (JP) | 2000-104473 |
| May 31, 2000 | (JP) | 2000-161768 |
| Dec. 19, 2000 | (JP) | 2000-384642 |

(51) Int. Cl.[7] ..... B43L 15/00
(52) U.S. Cl. ..... 248/118.1; 400/715
(58) Field of Search ..... 248/118, 118.1, 248/118.3, 118.5; 400/715; 297/411.21, 411.35, 411.36, 411.37, 411.38; 128/878

(56) References Cited

U.S. PATENT DOCUMENTS

| | | | | | |
|---|---|---|---|---|---|
| 633,021 | A | * | 9/1899 | Mason | 248/398 |
| 1,991,363 | A | * | 2/1935 | Hodny et al. | 248/182.1 |
| 4,069,995 | A | * | 1/1978 | Miller | 248/118.1 |
| 4,163,536 | A | * | 8/1979 | Heller et al. | 248/18 |
| 4,957,442 | A | | 9/1990 | Prater | 434/166 |
| 4,996,977 | A | * | 3/1991 | Tiedeken | 128/878 |
| 5,000,168 | A | * | 3/1991 | Lipson | 128/845 |
| 5,135,190 | A | * | 8/1992 | Wilson | 248/118.1 |
| 5,201,485 | A | | 4/1993 | Moss et al. | 248/118 |
| 5,321,556 | A | * | 6/1994 | Joe | 248/479 |
| 5,370,346 | A | * | 12/1994 | Long | 248/118.5 |
| 5,566,913 | A | | 10/1996 | Prokop | 248/118 |
| 5,686,005 | A | | 11/1997 | Wright, Sr. | 219/549 |
| 5,738,636 | A | * | 4/1998 | Saringer et al. | 601/29 |
| 5,810,712 | A | * | 9/1998 | Dunn | 600/114 |
| 5,868,687 | A | * | 2/1999 | Tedesco | 297/188.01 |
| 5,931,536 | A | * | 8/1999 | Wu | 248/118 |
| 6,039,292 | A | * | 3/2000 | Danzyger et al. | 248/118.5 |
| 6,074,012 | A | * | 6/2000 | Wu | 297/411.26 |
| 6,161,806 | A | * | 12/2000 | Crosson | 108/139 |
| 6,328,266 | B1 | * | 12/2001 | Yates | 248/118 |

FOREIGN PATENT DOCUMENTS

JP 409276077 A * 10/1997

* cited by examiner

*Primary Examiner*—Ramon O. Ramirez
*Assistant Examiner*—Jon Szumny
(74) *Attorney, Agent, or Firm*—TraskBritt

(57) ABSTRACT

The present invention relates to a pivotal armrest apparatus which comprises a cradle having a direct pivotal mechanism mounted on an anti-slip member. The pivotal mechanism automatically converts with the anti-slip member from the irregular movements of fingers (i.e. typing a keyboard) into stress releasing movements over the forearm without impairing a specific part of the wrist, whereby RSI can hardly be generated on the upper torso, nerves, and muscles. Also, the armrest enables a proper degree of rigidity to allow no drifting of the fingers, improves the repeatability of the finger position, and makes the installation area minimum while it is detachable and used as a comfortable rest means for respite.

32 Claims, 17 Drawing Sheets

FIG. 3A
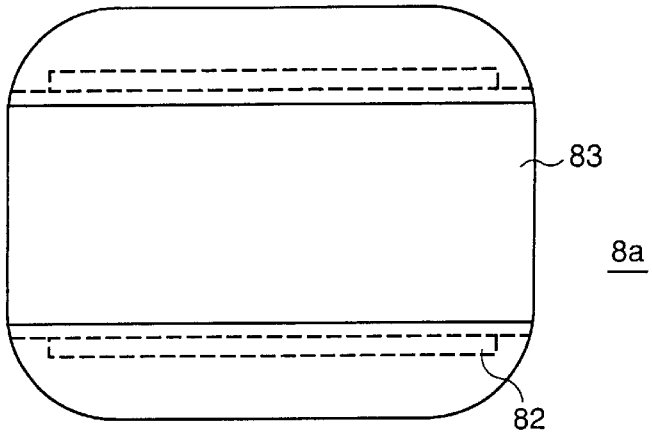
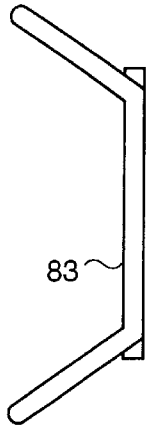
FIG. 3C
FIG. 3B
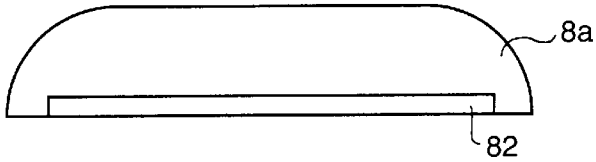
FIG. 3D
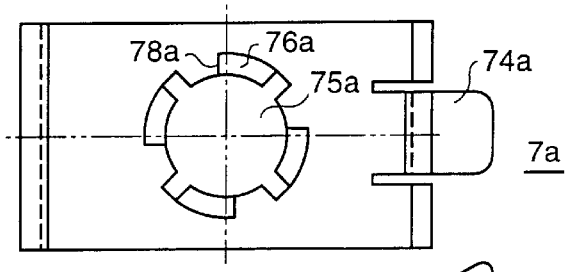
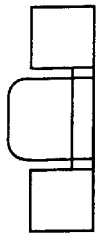
FIG. 3F
FIG. 3E
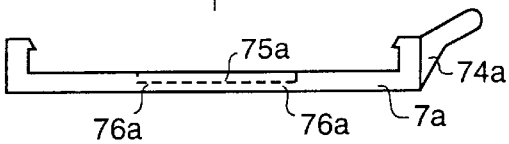
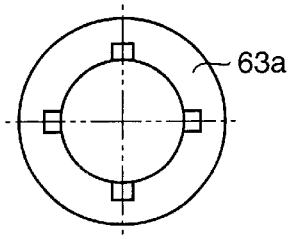
FIG. 3J
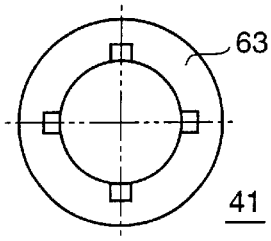
FIG. 3G
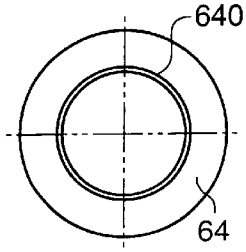
FIG. 3L
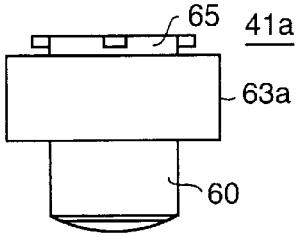
FIG. 3K
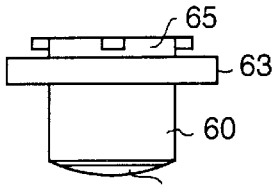
FIG. 3H
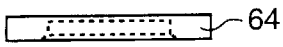
FIG. 3M FIG. 4A
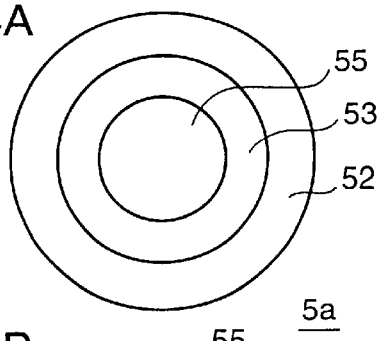
FIG. 4C
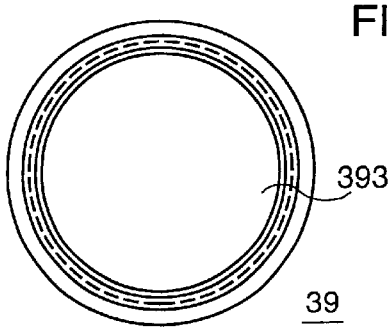
FIG. 4B
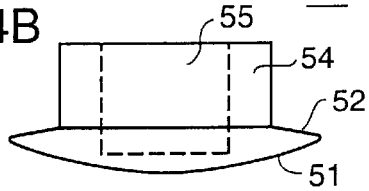
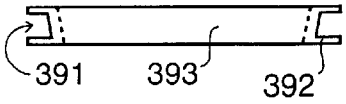
FIG. 4D
FIG. 4H
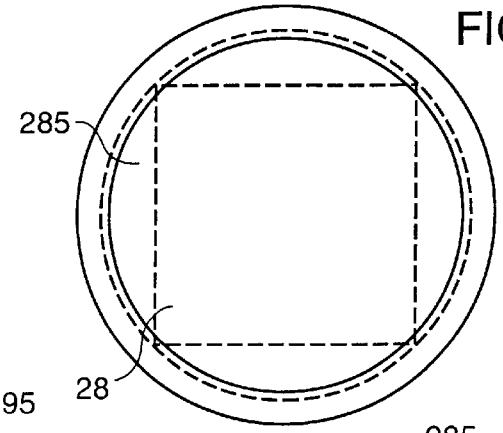
FIG. 4E
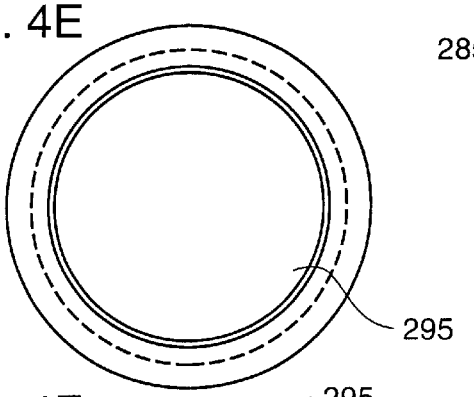
FIG. 4F
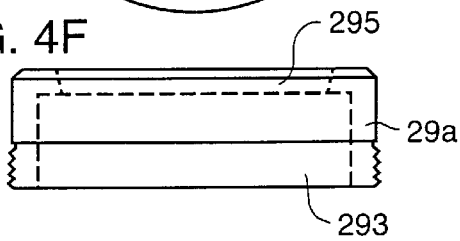
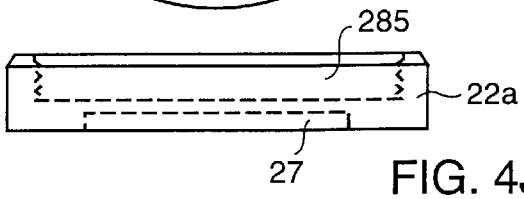
FIG. 4J
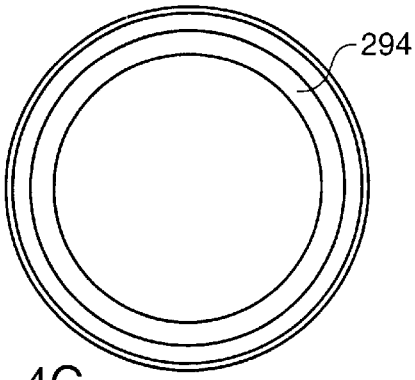
FIG. 4G
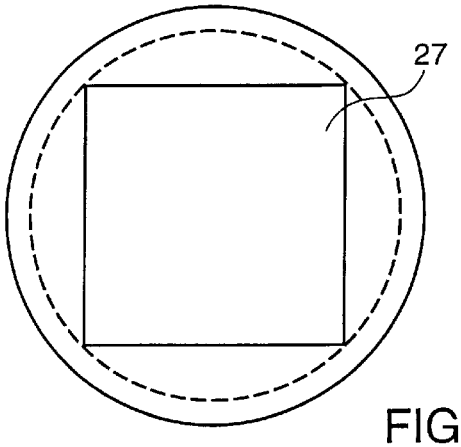
FIG. 4K 110
8a
22a
4a
241
24
242

7a
114
116
112
mp
110
1a
8a 110
112
114
242
29a
241
22a
26
8a 4a
8a
24
110

7a
114
8a
mp
110
2a 110
114
8a
2a
241
242
26

X
X
83
88
72b
5b
75b
8b
81b
9b=1b
138
129
26
6b
71b
38
110
4b
7b
85b
82
84
81
60b
73b
55
54
51

73C
72C
75C
62
71C
64
62
6C
63
5C
4C
51
38
391
31C
28
35
27

26
84
83
8C
82
81C
73C
72C
39C
4c
52
38
391
35C 26
22C
39C
392

5C
6C
38

27
21C
31C
32C
33C

35C

21C 81C
88
88

26

22C

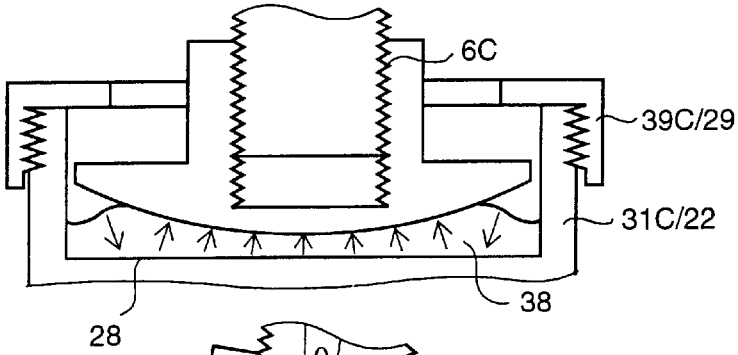
FIG. 9A
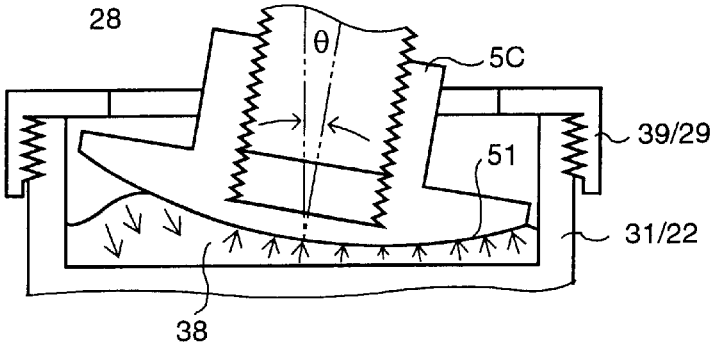
FIG. 9B
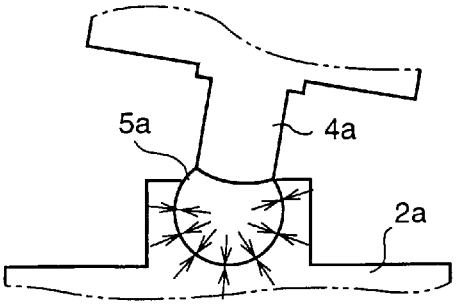
FIG. 9C
FIG. 9D
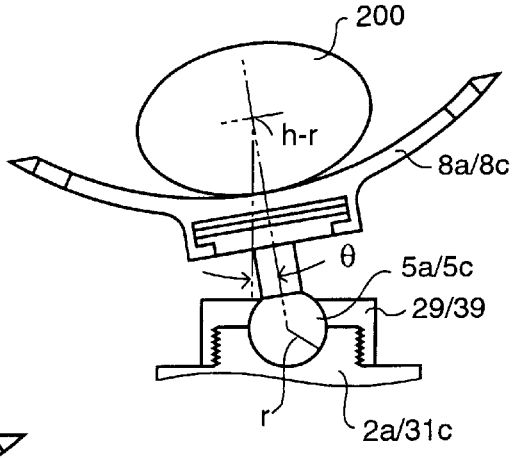
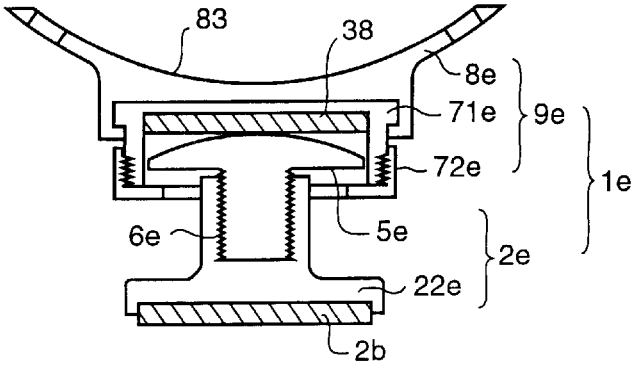
FIG. 9E FIG. 11A
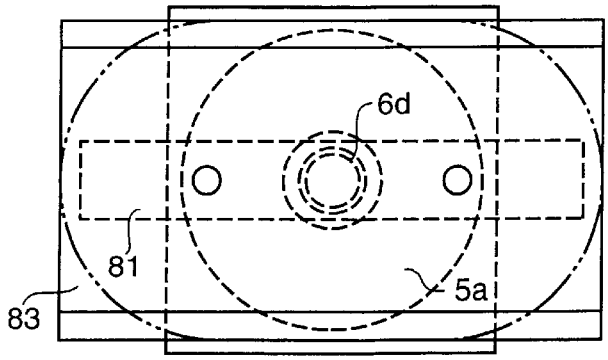
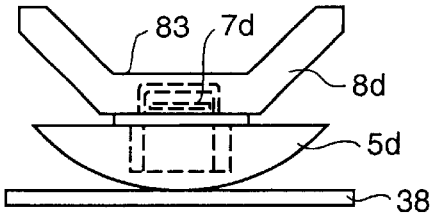
FIG. 11B
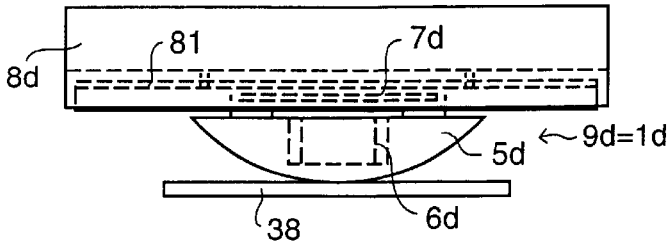
FIG. 11C
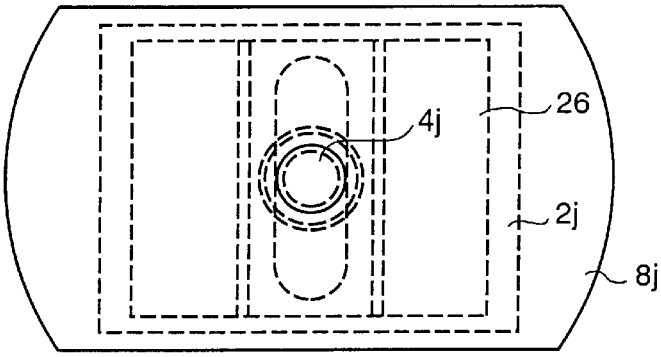
FIG. 11D
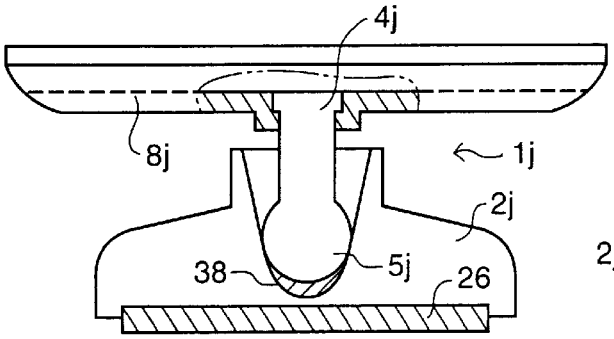
FIG. 11E
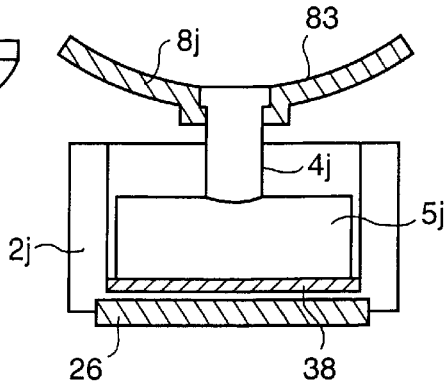
FIG. 11F

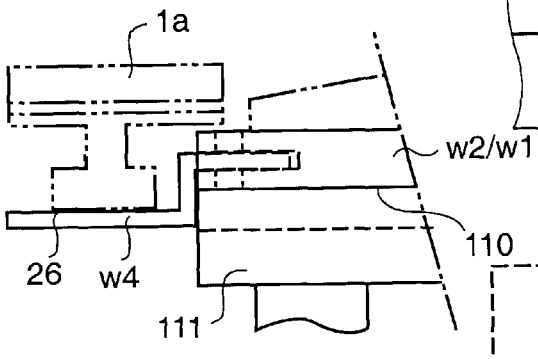
FIG. 14G
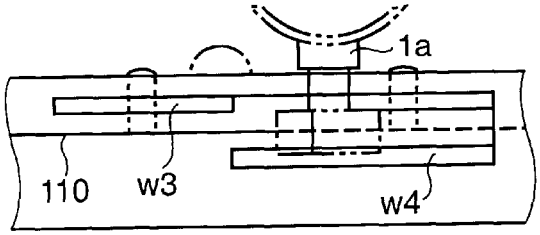
FIG. 14H
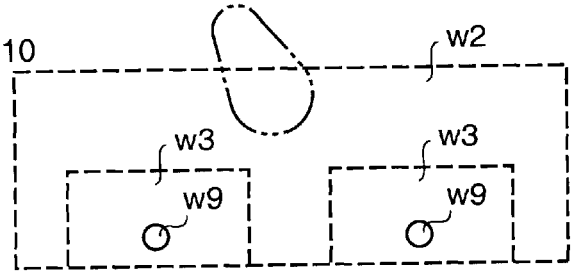
FIG. 14F
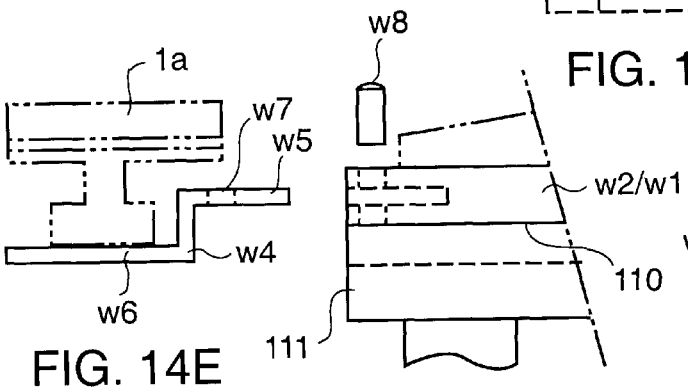
FIG. 14E
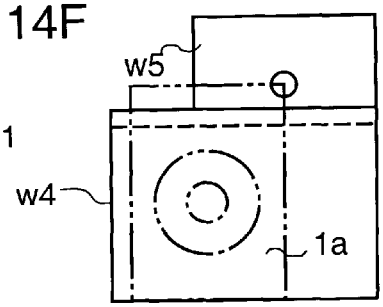

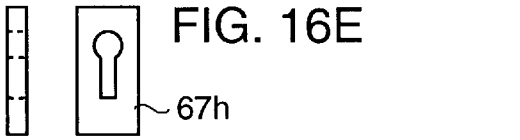
FIG. 16E
FIG. 16D
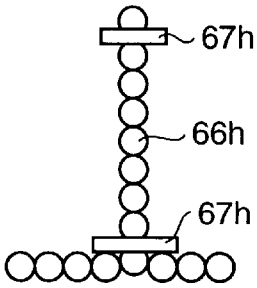
FIG. 16F
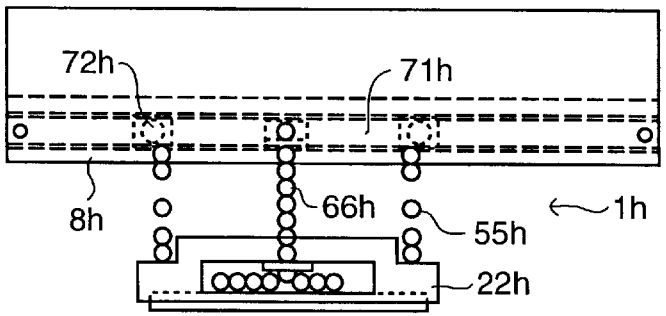
FIG. 16C
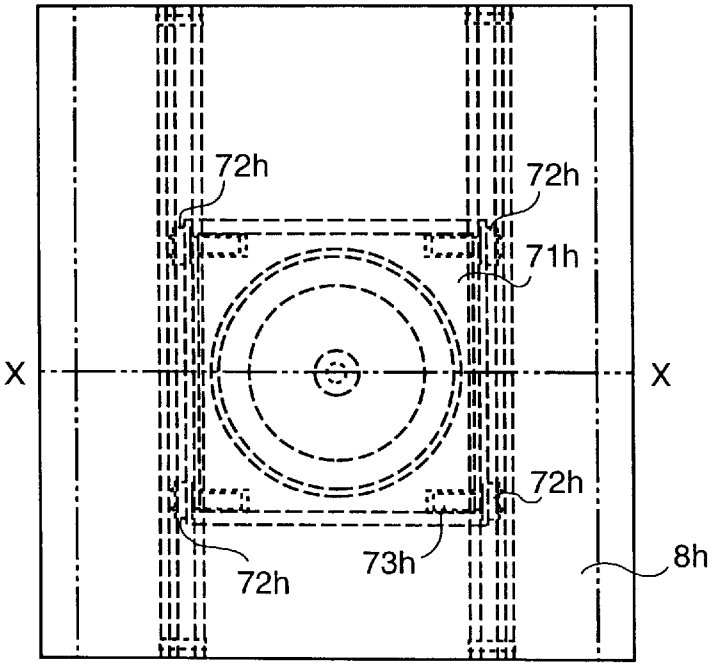
FIG. 16A
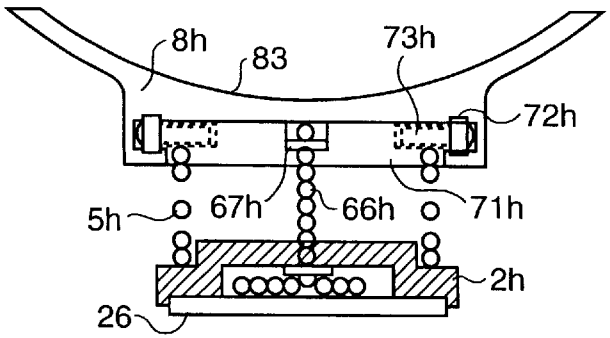
FIG. 16B

ARMREST APPARATUS

BACKGROUND OF THE INVENTION

1. Field of the Invention

This invention relates to a pivotal armrest apparatus having a pivotal mechanism directly mounted on an anti-slip member. The pivotal mechanism automatically converts with the anti-slip member from irregular finger-movements into stress releasing movements, whereby RSI (Repetitive Strain Injury) can hardly be generated on the upper torso, nerves, and muscles. Also, the armrest makes the installation area minimum while it is detachable and used as a comfortable rest means for respite.

2. Description of the Related Art

Usually, while keyboard users or typists use standard layout keyboards for carrying out e.g. word processing, their fingers are held over the home row position of it with their forearms extending horizontally at the height of the keyboard and their palms in parallel with the surface of it. However, such a standard attitude causes user to be tensioned at the hand, palm, forearm, upper arm, and backs. While the QWERTY-layout is a standard for keyboard, a variety of modified keyboards have been proposed for alleviating the discomfort of muscles, and nerves of users. However, those modifications are not widely accepted because users favor psychologically for the QWERTY-layout. It is thus desired to develop a user-friendly keyboard which can successfully reduce RSI while its design remains not departing from the standard layout.

B1) Japanese Patent Laid-open No. (Heisei) 7-200121 describes a keyboard having a pointer and a tilting device for carrying out a pointing action with the hand remaining placed over the keyboard. In particular, the keyboard has an ergonomic arrangement comprising a left key bank and a right key bank separated at an angle of 20 to 36 degrees by an intermediate fan-like shaped sector which extends towards the front of the keyboard and has a track ball provided therein.

B2) U.S. Pat. No. 5,058,840 (Moss et al) describes a device which is slidably moved while supporting the forearm of a user from bottom.

B3) U.S. Pat. No. 5,398,896 (Terbrack) describes a device which is longitudinally moved slidably and pivotally moved about z-axis and has a linkage mechanism.

B4) U.S. Pat. No. 5,884,974 (Bergstern et al) describes a chair having armrests for supporting wrists which are adjustable in the height and pivotal about z-axis and also slidable longitudinally.

B5) Japanese Patent Laid-open No. (Heisei) 10-211794 describes an arm support for a keyboard-user having a pivot attached to the distal end of a linkage mechanism. The linkage is secured to a desk edge by clamp. The device has a joint (pivot) for allowing the forearm of a user to operate smoothly.

B6) U.S. Pat. No. 5,158,256 (Gross) describes a device moving longitudinally and having an adjustable means in the height of the wrist.

B7) U.S. Pat. No. 5,597,208 (Bonutti) describes a device for a chair having a transfer means mounted on the upper end of an L-shaped support pipe thereof for sliding movement horizontally and rotary movements about three rotational axes independently.

B8) U.S. Pat. No. 5,683,064 (Copeland) describes a manually positionable support device, especially for a work surface, keyboard support or similar support platform.

B9) U.S. Pat. No. 5,730,408 (McAllister, et al) describes a workstation support for a keyboard and a mouse.

B10) U.S. Pat. No. 5,810,301 (McGrath, et al) describes an adjustable, sturdy upper body support assembly for keyboard operators.

B11) U.S. Pat. No. 6,042,064 (Hong) describes a wrist support suitable for use by computer users to reduce RSI comprising a cushion mounted from an articulated strut so as to be rotatable about three axes.

However, all the above described technologies have the following disadvantages. A subjective inventor-side-evaluation (good, medium, low, poor, void) of each technology is shown at the last line as follows; support function of the arm ( ), pivot function ( ), detachable function ( ), anti-RSI function ( ), rest function ( ), size ( ), durability ( ) production cost ( ).

C1) The keyboard described in B1) supports mainly palms but fails to provide any means for lifting the forearm in the air. The static load which results from holding forearms over the keyboard for a long time can hardly be decreased fundamentally.

CB1: support (void), pivot (void), detach (void), RSI (void), rest (void), size ( ), durability ( ), cost ( )

C2) The device described in 840 (Moss et al) has a support movable so as to be: (a) freely pivotable about z-axis; (b) freely slidable along its length. A cradle is supported from the distal end of the support so as to be freely pivotable about a yaw-axis, and in addition to pitch in a fore and aft direction relative to the longitudinal axis of the cradle. The pitch motion is controlled in part by biasing springs which bias the cradle to a neutral pitch position when an out-of-balance force is removed from the cradle. The slide means consisting of a concentric cylindrical form is moved longitudinally, it suffers from a high sliding resistance. The arm support is secured to the top of a table with a vacuum suction plate at its base. The support is used on the outside area of the base, and constantly received a gravity-moment created by the arm to the overturning direction. The required space for the slide movement is large above the top of the table, increasing the overall dimensions of the support. The cradle is supported by biasing springs, the forearm holds to stay substantially at a constant angular attitude, and this causes RSI during a long-term operation. The springs also cause fingers to drift slightly from one location to another, where by the accurate positioning of fingers needs its nerves and muscles being tensioned continuously.

CB2: support (medium), pivot (void), detach (low), RSI (low), rest (void), size (poor), durability (poor), cost (poor)

C3) The device described in 896 (Terbrack) comprises an elongate guide-track and a pair of support assemblies which are adapted to support user's palms adequately. Each of the support assemblies comprises a carriage slidably engaged to the guide-track and a linkage pivotally connected to the carriage. The pivotal connection and the slidable engagement of the carriage facilitates dynamic lateral and longitudinal movement of the support and hence the user's hands relative to the guide track. A pin in the linkage is hardly increased in the diameter, the strength is hardly enough to. The height control along z-axis is hardly considered, the forearm is hardly free from RSI. The rotatable linkage causes fingers to drift slightly from one location to another, the supported arm needs its nerves and muscles being tensioned continuously.

CB3: support (poor), pivot (void), detach (void), RSI (poor), rest (void), size (poor), durability (poor), cost (poor).

C4) The arm support described in 974 (Bergstern) is installed at a desk edge with clamp, and this causes a drawback of the drawer. The support occupies a broad surface of the desk. The sliding shaft of the support is constructed by a point contact, it receives concentrated loads and if worse, will bend down. The support once installed may hardly be removed, and includes a large number of components thus increasing the overall cost.

CB4: support (low), pivot (void), detach (void), RSI (poor), rest (void), size (poor), durability (poor), cost (poor)

C5) The arm support described in B5) has a similar drawback to 974 (Bergston). A linkage to the support occupies a bulky space of the desk, or the clamp shape of the linkage varies very widely matching to the edge shapes of the desks to be attached to. The clamp has a weak strength and impairs the surface of the desk. After a long-term use, the pivot may be impaired slippery thus making the support unstable. In case of mass-production, the compatibility of the pivot may hardly be guaranteed. The support is pivotally connected to the distal end of the linkage constantly receiving a gravity-moment created by the arm to the overturning direction, and causing fingers to slightly drift from one location to another, then the supported arm needs its nerves and muscles being tensioned continuously.

CB5: support (medium), pivot (medium), detach (poor), RSI (low), rest (void), size (low), durability (low), cost (medium).

C6) The device described in 256 (Gross) supports mainly the palm rather than the forearm, and the platform is located in the front side of a desk. The structure of the arm support is very intricate, and a detachable step of it is also very intricate. A movement of the wrist is very limited, and the platform disturbs using the center drawer of the desk.

CB6: support (poor), pivot (void), detach(void), RSI (poor), rest (poor), size (poor), durability (poor), cost (poor)

C7) The device described in 208 (Bonutti) has a slide member and three pivot joints. Three pivot joints occupy very bulky space, and the clamp of the base to a desk is obsolete, many projections of the device collide with the chair or impair the body of a user or his clothes.

CB7: support (medium), pivot (medium), detach (poor), RSI (low), rest (low), size (poor), durability (poor), cost (poor)

C8) The device described in 064 (Copeland) is installed to the underside of a desk. Its installation deteriorates the physical strength of the desk, and disturbs the use of a drawer. A detachable step of it is very intricate.

CB8: support (poor), pivot (void), detach (void), RSI (poor), rest (void), size (poor), durability (poor), cost (poor)

C9) The device described in 408 (McAllister) has an arm to a mouse pad, and a mouse support table is adjustably attached to it via an off-center rotational joint. The arm is broken down when receiving the overall weight of the user, and the structure of the arm is very intricate.

CB9: support (void), pivot (low), detach (void), RSI (poor), rest (void), size (low), durability (low), cost (medium)

C10) The system described in 301 (McGrath) has an adjustable, upper body support assembly for keyboard users including a pair of adjustable armrests mounted on a rigid frame. The assembly is positioned adjacent and partially underneath a piece of furniture. The assembly also includes a support frame and an upper body support apparatus. The support apparatus is movably engaged with the frame to permit the apparatus to be moved underneath a piece of furniture when not in use. The support system is very large, required a huge installation space, scrapping the old desk, wasting resources. The armrest has no pivot function, and its cost is very high.

CB10: support (poor), pivot (void), detach (poor), RSI (poor), rest (low), size (poor), durability (low), cost (poor)

C11) The device described in 064 (Hong) has a wrist support to reduce RSI comprising a cushion mounted from an articulated strut so as to be movable about three axes whereby it may yaw, pitch and roll relative to the strut, and a spring to bias the cushion to a neutral pitch and roll position. But the structure based on three axes requires a relatively large complex one, the size of the support under the cushion is large. The articulated strut is a kind of linkage constantly receiving a gravity-moment created by the arm to overturning direction, and causing fingers to slightly drift from one location to another, the supported arm needs its nerves and muscles being tensioned continuously.

CB11: support (medium), pivot (medium), detach (poor), RSI (medium), rest (low), size (low), durability (low), cost (low).

C12) In a data entry operation for 3-DCAD software, its user has to hold and operate a mouse continuously for irregular and complicated motion while its forearm remaining lifted up over two or four hours and may feel fatigue or pain on his arm. Some users for advanced CAD software claim that they feel a kind of fatigue just when watching the mouse. With its personal computer and keyboard placed together on a desk, the space for operating the mouse on it should be saved as small as possible. We, the inventors, found through a series of mouse operating actions that the controlling of the mouse is easy by conducting a combination of the translation motion and the angular rotations when the forearm remains held not to move linearly in x-y directions but rotatable for shifting its angular attitude in a system, the wrist is floating freely in all directions.

In summarizing the description in C1 to C12, the RSI problems ever since type-writers and computers were introduced are now focused and their solutions are attempted particularly by manufacturers, distributors, and end users with lots of failures due to multiple reciprocal requests existing in the problems. So far, no convenient devices are provided for fundamentally eliminating the above problems. As the fingers or wrist of a user is generally fixed within a limited range of the space, its movable range is allowed no large spatial freedom by the initial given conditions. Also, as the conventional devices of the prior art are designed for supporting pain-portions of the hand near the wrist, its mechanism is limited by pain-conditions thus narrowing motion of wrists. This will be disadvantageous particularly to the long-acting user.

For example, when user operates an entry means of a computer at a same location and at a same attitude, it may suffer from RSI on his muscles, chords, and nerves. Even when translation motion and rotating movements are permitted by the action of a linkage, the operating position of the hand is only shifted from one location to another on the same horizontal plane, and no attitude changes are derived from action of the linkage. For preventing from drifting largely from their initial operating position, the arms of user have to be tensioned more or less on the upper torso. Accordingly, RSIs remain unsolved. The conventional mechanism for permitting the rotating movements in three degrees of freedom (DOF) is based on the armrest combined with a rotary mechanism for having three independent axes as described in the paragraphs B7 and B11 and its structure becomes very bulky and complex, hence making the installation on the desk difficult.

C13) As a conventional armrest comprises a device for supporting the forearm and a transfer means which are separately provided and assembled not integrally, it needs relatively wider area for installation. Also, as typically described in the paragraph B10, a dedicated set of a desk and a chair for operating a computer is commercially available. When such a new set is obtained, the existing desk is no more needed and may be wasted leading to losses of resources. The dedicated set of desk is unfavorable for use in different applications. The desk once used with a conventional armrest exhibits undulations or dents in its upper or side surface and maybe found of no use. This will decline the efficiency of utilization of a room where the desk is installed and force the owner of the room to charge a higher fee to a tenant.

SUMMARY OF THE INVENTION

The inventors have pointed out that a mechanism for physically supporting the forearm of user at its center-of-gravity (while the hand remain substantially floating in the air) is much friendly to movements of the hand. The present invention is developed in view of the above aspects and its object is to provide a pivotal armrest apparatus which is comfortable for operating a keyboard or a mouse, and will invite very little RSI-problems when used for a long period of time.

An advantage of the present invention is to provide an armrest in which a pivotal mechanism mounted on an anti-slip member is introduced to provide a soft-rigidity for the pivot motion, and this invites a simple structure, a very comfortable controllability in use, and very little RSI-problems.

For the achievement of the object, an armrest apparatus according to the present invention is comprising:

a base member detachably mounted on the surface of a table or desk;

a cradle means supporting an elbow-side portion of a forearm from the wrist; and said base member and said cradle means further including a pivotal mechanism formed by directly connecting to each other; and said pivotal mechanism including a pivotably curved-surface of a predetermined shape, wherein while said forearm is supported by said cradle means, the location and the attitude of said forearm can be controlled in any desired movement by said pivotal mechanism.

For another achievement of the object, an armrest apparatus according to the present invention is provided comprising:

a cradle means supporting an elbow-side portion of a forearm from the wrist;

a pivotal mechanism formed by directly mounting said cradle means on the surface of a table or desk;

an anti-slip member interposed between said cradle means and said surface of a desk; and said pivotal mechanism including a pivotably curved-surface of a predetermined shape, wherein while said forearm is supported by said cradle means, the location and the attitude of said forearm can be controlled in any desired movement by said pivotal mechanism.

According to the present invention, a method for installing an armrest apparatus on a surface of a desk, said armrest apparatus including a base member detachably mounted on the surface of the desk and a cradle means supporting an elbow-side portion of a forearm from the wrist, the steps of the method comprising:

forming a pivotal mechanism by directly connecting said base member and said cradle means to each other; and, mounting said base member on said surface of the desk at a desired location.

Our invention will be explained in greater detail in relation to preferred embodiments thereof, as shown in the accompanying drawings.

BRIEF DESCRIPTION OF THE DRAWINGS

FIG. 3A is a plan view of cradle member 8*a*; FIGS. 3B and 3C are a side view and a front view of the same; FIG. 3D is a plan view of engaging means 7*a*; FIGS. 3E and 3F are a front view and a side view of the same; FIG. 3G is a plan view of post member 41; FIG. 3H is a front view of the same; FIG. 3J is another plan view of post member; FIG. 3K is a front view of the same; FIG. 3L is a plan view of spacer 64; FIG. 3M is a front view of the same;

FIG. 4A is a plan view of joint member 5*a*; FIG. 4B is a front view of the same; FIG. 4C is a plan view of fitting member 39; FIG. 4D is a front view of the same; FIG. 4E is a plan view of cover 29*a*; FIGS. 4F and 4G are a front view and a bottom end view of the same; FIG. 4H is a plan view of platform 22*a*; FIGS. 4J and 4K are a front view and a bottom end view of the same;

FIG. 9A is a sectional view of first transfer means 31*c*; FIG. 9B is a sectional view of surface 83 tilted by an angle of θ.FIG. 9C is a sectional view of joint member 5*a* having a relatively smaller diameter r and supported by a rotary-sliding mechanism. FIG. 9D is a sectional view of surface 83 tilted by an angle of θ. FIG. 9E illustrates a joint member 5*j* modification that may be belonged to base member 2*e*.

FIGS. 10G to 10J illustrate a foldable armrest 1*u*. FIG.

10G is a plan view of folded armrest 1*u*. FIG. 10H is a sectional front view of non-folded armrest 1*u*. FIG. 10J is a sectional side view of folded armrest 1*u*.

FIGS. 11A to 11C illustrate a modification of an armrest made of wood. FIG. 11A is a plan view of armrest 1*d*. FIGS. 11B and 11C are a front view and a side view of the same. FIGS. 11D to 11F illustrate a modification of an armrest having a cylindrical curved-surface. FIG. 11D is a plan view of armrest j. FIGS. 11E and 11F are a side view and a sectional front view of the same.

FIG. 12 illustrates armrest 1*v* made of a balloon.

FIG. 13 illustrates a vacuum-suction type detachable member 20*v*.

FIG. 14 illustrates a resources-saving type desk-system sys1 where armrest 1*a* is mounted and dismounted from the near side of a desk. FIG. 14E is a sectional view of the system before accepting thin plate w4. FIG. 14F is a plan view of the same. FIG. 14G is a sectional view of the system after accepting thin plate w4. FIG. 14H is a plan view of the same.

FIG. 15 illustrates a parallel arrangement of a mat implanted with needle-like members 12 bonded on surface 83 and an externally driven rocking mechanism 16.

FIG. 16 illustrates an armrest 1*h* provided with cradle means 9*h* which has transfer mechanism 7*h* arranged for rocking movements in forward, backward, upward, downward, leftward, and rightward directions and sliding movement in one direction. FIG. 16A is a plan view of an entire arrangement of armrest 1*h*. FIG. 16B is a sectional view taken along line X—X of FIG. 16A. FIG. 16C is a side view of the same. FIGS. 16D and 16E are a side view and a front view of restricting means 67*h* for height control chain 66*h*. FIG. 16F illustrates height control chain 66*h* for cradle member 8*h* at a locking state.

DETAILED DESCRIPTION OF THE PREFERRED EMBODIMENTS

Figure 1A:
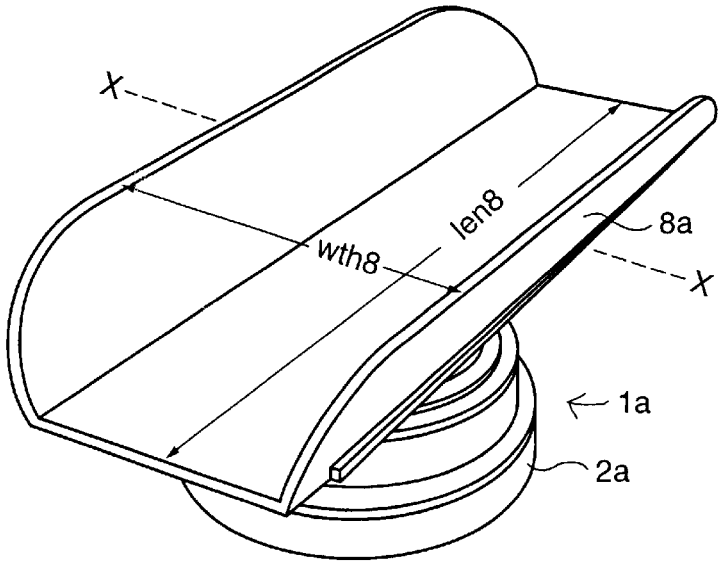
FIG. 1A is a perspective view of an armrest apparatus 1*a*.
Figure 1B:
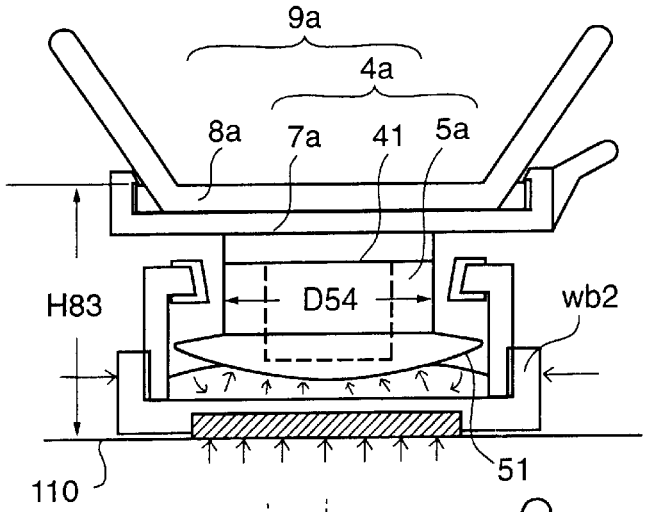
FIG. 1B is a sectional view taken along line X—X of FIG. 1A.
Figure 1C:
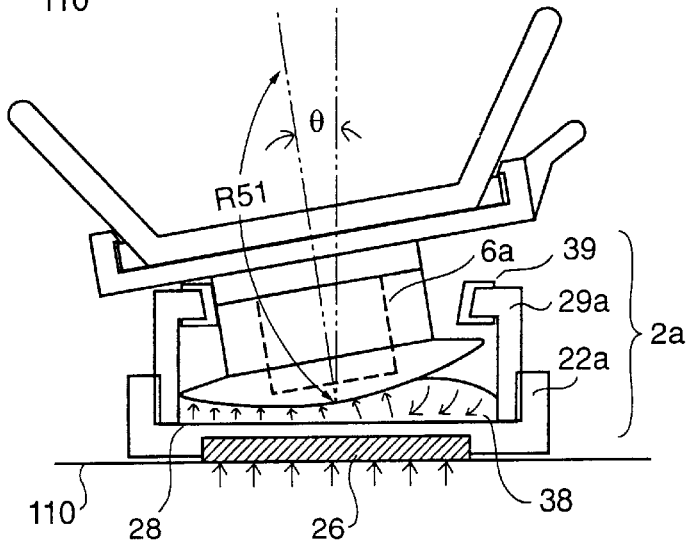
FIG. 1C is a sectional view of surface 83 tilted by an angle of θ.
Figure 2:
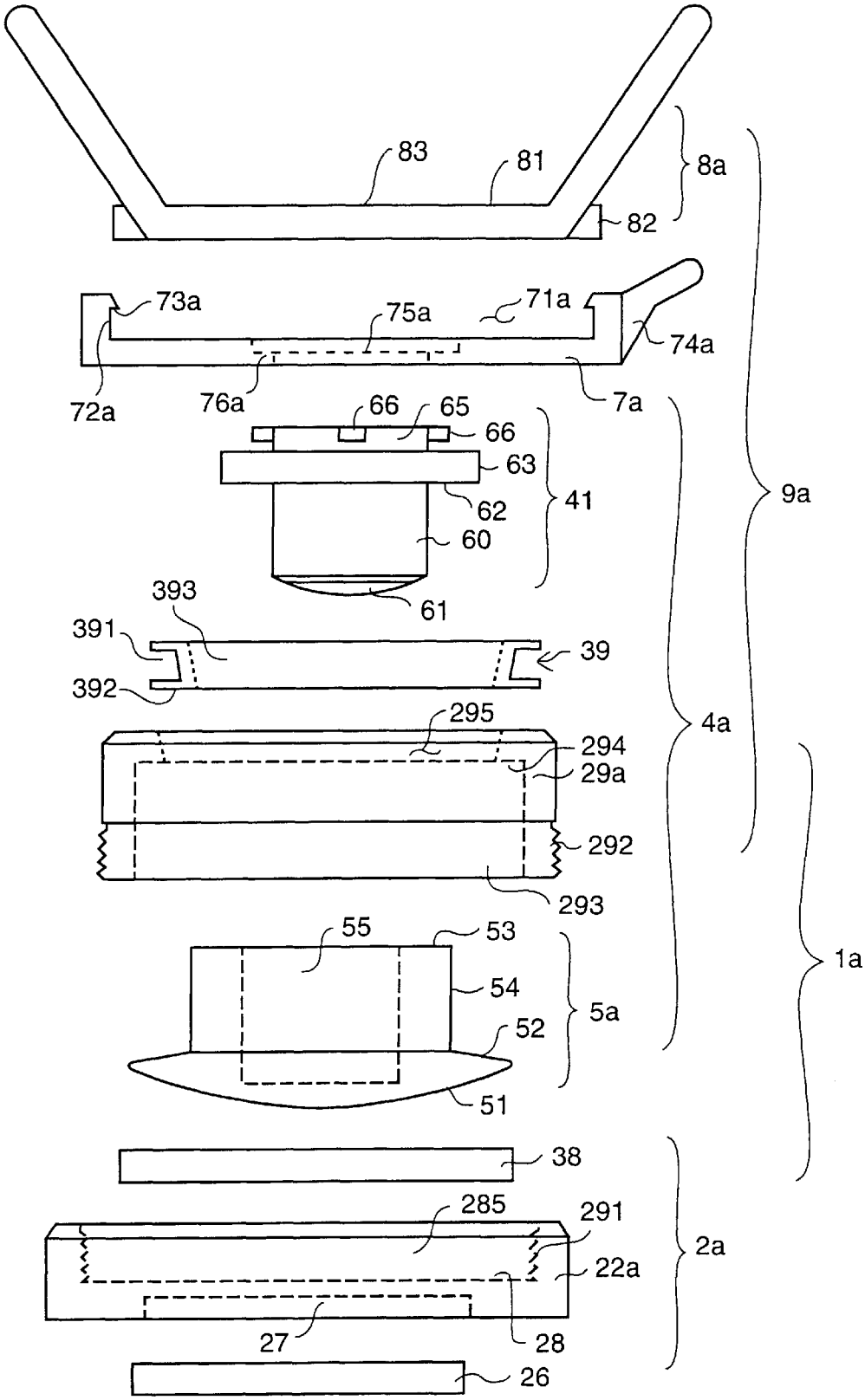
FIG. 2 is an exploded assembly views of armrest 1*a*.

FIGS. 1 to 5 illustrate an embodiment of the present invention, an armrest apparatus 1*a* which comprises two member, that is, a base member 2*a* which is detachably mounted on the surface 110 of a table or desk, and a cradle means 9*a* which is supporting an elbow-side portion of the forearm from the wrist as shown in FIG. 2. The cradle means 9*a* is associated with the base member 2*a* to form a pivotal mechanism 5*a* by connecting directly with each other, and by connecting detachably with each other. Preferably an anti-slip member 38 is interposed between base member 2*a* and cradle means 9*a*.

In one preferable association example, cradle means 9*a* is mounted on base member 2*a* to form pivotal mechanism 5*a*, which consists of a joint member 5*a*, the anti-slip member 38, and a flat-bottom 28 of base member 2*a*. In joint member 5*a*, a pivotably curved-surface 51 is formed at a lower portion of cradle means 9*a*, and directly mounted on bottom face 28 in an upper recess 285 of base member 2*a*. The radius R51 of curved-surface 51 (if formed by a part of a sphere) may range from 10 mm to 120 mm, and preferably from 50 mm to 90 mm. An upper or taper surface 52 of joint member 5*a* is sloped down towards the outer edge (preferably at an angle of 5 to 10 decrees to define the tilting angle of cradle means 9*a*) and beveled or rounded at the outer edge. Also, surface 52 may be mounted by a shock absorbing material, an elastic material such as urethane resin, or a gel material for absorbing any undesired impact.

Cradle means 9*a* comprises a support member 4*a* and a cradle member 8*a*, and the support member 4*a* comprises the pivotal mechanism 5*a*, a rotatable mechanism 6*a*, and an engaging means 7*a*. In FIG. 2, support member 4*a* is included in cradle means 9*a*. The engaging means 7*a* is a fore and aft adjusting means of the cradle member 8*a*, and cradle 8*a* can be attached to and detached from support member 4*a* by a lever 74*a* operation. In cradle member 8*a*, an engaging portion 82 is formed on the bottom, and fitted into a recess 71*a* in engaging means 7*a*.

The rotatable mechanism 6*a* comprises joint member 5*a* and a post member 41, where the post member 41 is rotatably fitted at a lower post 60 into a recess 55 formed in joint member 5*a*. Thus, joint member 5*a* and cradle member 8*a* are rotatably connected with each other by rotatable mechanism 6*a*. Post member 41 is detachably fitted into joint member 5*a*, detachably fixed to engaging member 7*a*, and has a height control function in later described.

When the forearm of a user operating a mouse or keyboard is mounted on a contact surface 83 of cradle member 8*a*, it can be supported by the action of cradle means 9*a* as lifted freely in the air above the moving plane mp (shown in FIG. 5B) on which the mouse is operable. More specifically, the forearm mounted on cradle means 9*a* can be driven to any desired location (x, y, z) and attitude ($\alpha$, $\beta$, $\gamma$) by pivot motion of curved-surface 51 which will be described later in more detail. This allows surface 83 to be moved rotatably and pivotably to vary its height along z-axis. It is preferable in armrest 1*a* to support the arm from below and the forearm may be held at about the center-of-gravity. More specifically, the forearm is mounted on cradle means 9*a* at a location distanced about ½ from the elbow (ideally best at the center-of-gravity in view of the dynamics which may hardly be assured on a normal office environments and in practice, preferably at a location distanced ⅕ to ¾ from the wrist, more preferably ¼ to ⅔ from the wrist). It is also preferable that with cradle 9*a* directly mounted on base member 2*a*, armrest 1*a* is detachably adhered or fixed from the above or from the near-side to a desired location on surface 110 of a desk.

Base member 2*a* in FIG. 2 comprises a platform 22*a*, a cover 29*a*, anti-slip member 38 mounted on upper recess 285 of platform 22*a*, and a detachable member 26 (provided as an anti-slip material, and attached to a lower recess 27 of platform 22*a*). The detachable member 26 attached to bottom of base member 2*a* prevents base member 2*a* or armrest 1*a* from being overturned, and all of the base members 2*a* are detachable. Platform 22*a* may preferably have a round shape or a rectangular shape, including a square, in the cross-section which is easily machined. When platform 22*a* has finger engaging flat-plane on the outer side, such as of a hexagonal nut, its attachment and detachment as well as positioning can be carried out with much ease. The same effect is gained by forming a knurled region on platform 22*a* horizontally or vertically.

Detachable member 26 is preferably made of an adhesive material, a pressure sensitive adhesive such as urethane rubber, which is very high in the viscosity and the tackiness, and more preferably laminated by double-sided adhesive tape (having a sheet coated at both sides with a highly adhesive material which can easily be adhered to the bottom at lower recess 27. Detachable member 26 may have a thickness of 1 mm to 15 mm, preferably 2.5 to 6 mm, and more preferably 3 to 5.5 mm.

Platform 22*a* having a female thread 291 at upper recess 285 is engaged with a male thread 292 on the outer side of cover 29*a*. Cover 29*a* has a center opening 295 in the upper side for accepting support member 4*a*, and a recess 293 in the lower side. A fitting member 39 (made of a ring-like thin elastic material such as urethane resin, and having an annular recess 391 in the outer side ) is fitted into center opening 295 for cushioning or attenuating the sound of collision between cover 29*a* and support member 4*a* at bottom 392 and opening 393.

While anti-slip member 38 is mounted on surface 28 at the upper recess 285 for preventing joint member 5*a* from slipping away, cover 29*a* serves as a restricting means of pivot motion for support member 4*a*, and further serves as a dust-proof means of pivot motion for anti-slip member 38. Also, when cover 29*a* has finger engaging flat-plane on the outer side, it can readily be turned by hand for threading in and out along thread 292. The same effect is gained by forming a knurled region on the outer side of cover 29*a* horizontally or vertically.

Anti-slip member 38 may be made of an adhesive material, a pressure sensitive adhesive such as silicone gel, which is high in the viscosity and the elasticity and shock absorbency. The thickness of anti-slip member 38 ranges from 1 mm to 15 mm, preferably 2.5 mm to 6 mm, and more preferably, 3 mm to 5.5 mm. Anti-slip member 38 of a rectangular shape may fully cover the entire area of bottom 28 at upper recess 285. It is found through experiments that the size of anti-slip member 38 may be shortened to ½ or ⅓ size of curved-surface 51. An anti-slip material, an annular elastic material such as urethane resin, a gel material, or a combination thereof may be interposed between cover 29*a* and cradle means 9*a* to attenuate collision noises.

Support member 4*a* consists (as a lower section of cradle means 9*a*) from below, of joint member 5*a*, post member 41, engaging means 7*a* having a narrowed joint portion 76*a* for closely fitting engagement with post member 41. Joint member 5*a* and post member 41 are detachably joined to each other by rotatably fitting at recess 55. Post member 41 and engaging means 7*a* are also detachably joined to each other by closely fitting at an engaging opening 75*a*.

A flange 63 extending radially is formed on the uppermost end of post lower body 60 which has a bottom 61 at the lowermost end. The diameter D54 of flange 63 determines the physical strength of post member 4*a* and cradle means 9*a*, and may preferably range from 5 mm to 60 mm, and more preferably 15 to 40 mm. When flange 63 is formed into a hexagonal, or polygonal shape in cross-section, it can easily be held by hand for fitting post member 41 into recess 55. The same effect may be gained by knurling on the outer side of post member 41 horizontally or vertically. The lower side of flange 63, that is sliding surface 62, is slidably joined to upper side 53 of joint member 5*a* so that they can directly be turned from each other. Flange 63 maybe modified for the height control of surface 83 as shown in FIGS. 3H and 3K. As the length of flange 63 is vertically changed or a ring-like spacer 64 in FIG. 3M is mounted on post lower body 60, height H83 (in FIG. 1B) from surface 110 of a table to surface 83 of cradle member 8*a* can desirably be adjusted. In case that armrest 1*a* is directly installed on surface 110 for data entry, height H83 is preferably 25 to 70 mm, and more preferably 30 to 60 mm. When armrest 1*a* is used for medical applications, or mounted on a working table for carrying out a precision work, height H83 is preferably 25 to 250 mm. Height H83 is more preferably 30 to 150 mm for conducting an elaborate work.

At the other end of post member 4*a*, a group of projections 66 are formed on a post upper body 65 of the same for engagement with the engaging opening 75*a* of engaging means 7*a*. In FIG. 3D, post member 41 is joined to the narrowed portion 76*a* by turned counter-clockwisely until it is held with stoppers 78. Cradle member 8*a* can detachably mounted to engaging means 7*a* with engaging portion 82 fitted in recess 71*a*, and the manual opening and closing action of lever 74*a* enables a fore and aft adjustment of cradle member 8*a*. The moving mechanism of cradle member 8*a* may be of either a portal type or a monorail type. As shown in FIGS. 2 and 3, the monorail structure requires less space for installation than the portal structure and will thus be advantageously employed, allowing the upper space of base member 2*a* to be used effectively.

A base body 81 of cradle member 8*a* is formed into an arch shape in cross-section and rounded at the corners of both, forward and backward, ends. The upper edges of left and right wings are also beveled or rounded for allowing the forearm moved in an extended range freely. For reducing the weight and improving the ventilation of air of cradle 8*a*, base body 81 may be perforated to have a multiplicity of tiny holes or surface 83 may be covered with an air-permeable urethane rubber material. Engaging means 7*a* may be replaced by a slidable transfer mechanism which will be described later. As proved through experiments, engaging means 7*a* having a relatively higher degree of the resistance to movement is preferably used for typing a keyboard or reading books. When cradle member 8*a* is longer in the length along x-y axes horizontally than base member 2*a* or engaging means 7*a*, armrest 1*a* will have minimum projections and is improved in the appearance, thus requiring a minimal space for the installation. As engaging means 7*a* and cradle member 8*a* are located above support member 4*a*, a free space is insured between engaging means 7*a* and surface 110. The free space will hence be utilized effectively. Also, as engaging means 7*a* is extended horizontally to support cradle 8*a*, it cooperates with rigid support member 4*a* to increase the physical strength of cradle means 9*a*.

When cover 29*a* is fitted into upper recess 285, there are provided minimum projections and cradle 8*a* or engaging means 7*a* can be in direct contact at its lower side with the upper side of cover 29*a*, thus increasing the tiltable range of cradle means 9*a*. Also, when cradle member 8*a* attached to post member 41 has been removed from recess 55, base member 2*a* only remains on surface 110 of a desk. This improves the attach and detach operation into one-touch operation of cradle 8*a*, and the space above base member 2*a* after dismount of cradle 8*a* can be used for other applications freely. Detachable member 26 may be made of an anti-slip member for secure installation on surface 110, and can thus be mounted at a desired location on surface 110. Also, detachable member 26 may be layered by a plurality of materials as in FIG. 14D which are different in the tackiness for adjusting an optimum level of the tackiness according to the characteristics of surface 110. As armrest 1*a* is mounted on surface 110, it will hardly interrupt the movement of drawers of the desk, collide with a chair, and injure any garment, a set of furniture, or the desk itself. As detachable member 26 is pressed by the weight of the forearm to a vertical direction, armrest 1*a* is received no overturning moments from the forearm.

In case of dismounting armrest 1*a* from surface 110, it is very easy, grip base member 2*a* by hand, then slowly lift it up. That is all.

In view of the degree of freedom (DOF) of arm-motion, armrest 1*a* of the present invention has discrete and predictable ones. In pivotal mechanism 5*a*, joint member 5*a* can be controlled by the pivotably curved-surface 51 in three discrete (first to third) rotational DOFs for 3-D rotations (yawing, pitching, and rolling) at simultaneous operation. This allows the forearm to be shifted predictably to a desired position in the height, angle, and direction (whereby RSIs will be eliminated). Also, joint member 5*a* can be controlled in three discrete (fourth to sixth) DOFs for local translation motion (along x, y, and z axes). Cradle member 8*a* can be controlled by rotary mechanism 6*a* (in the seventh DOF) for the rotary movement about z-axis. Moreover, cradle member 8*a* can be controlled by the engaging means 7*a* for a fore and aft direction along portion 82 (in the eighth DOF).

Figures 5A, 5B, 5C, 5D, 5E, 5F:
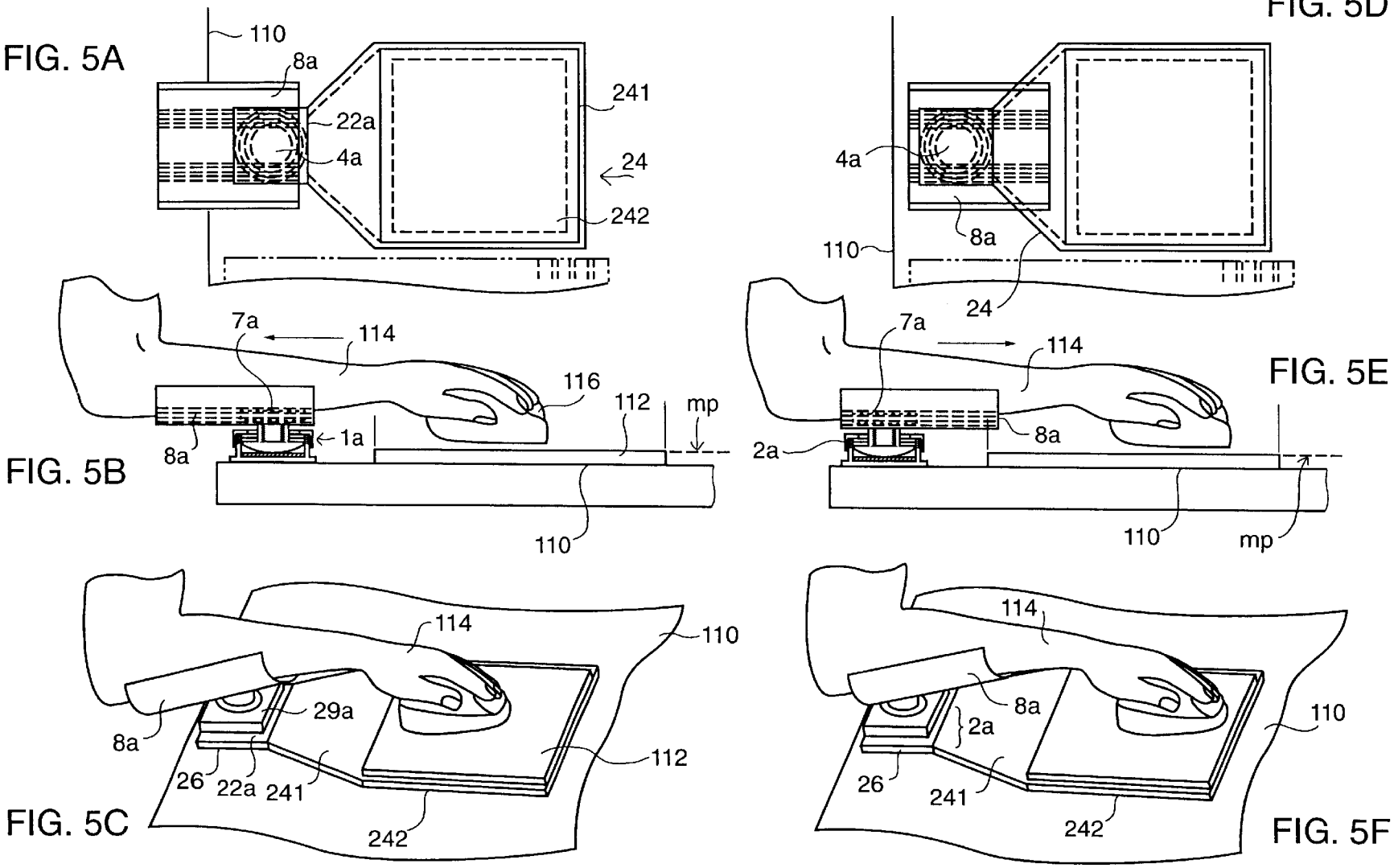
FIG. 5A is a plan view of armrest 1*a* with a mounting plate 24.
FIG. 5B is a side view of the same with forearm 114.
FIG. 5C is a perspective view showing the same.
FIG. 5D is a plan view of cradle member 8*a* located at the frontward end.
FIG. 5E is a side view of the same with forearm 114.
FIG. 5F is a perspective view of the same.

The action of armrest 1*a* having the above described DOFs will now be described referring to FIGS. 1 and 5. Illustrated in FIG. 5 is a combination of armrest 1*a* with the mouse pad/keyboard mounting plate 24, joined to base member 2*a* by an upper layer 241 (a planer sheet), and adhered with a lower layer 242 (pressure sensitive adhesives) to surface 110. Plate 24 allows cradle member 8*a* to hardly detach from or overturn on surface 110. As mounting plate 24 detachably extends from platform 22*a*, they are securely mounted by adhesive materials 242 and 26 to surface 110. In FIG. 5B, cradle member 8*a* is adjusted at its backward end of engaging means 7*a*, and supporting forearm 114 of a user which holds and operates a mouse 116 without overturning. In FIG. 5D, cradle member 8*a* is adjusted at its forward end of engaging means 7*a*. As shown in FIGS. 5B and 5E, forearm 114 rested on cradle member 8*a* is held above the moving plane mp of mouse 116, and travels with mouse 116 running directly on the operating plane mp.

FIG. 9C illustrates a modification of armrest 1*a* where joint member 5*a* is directly fitted for pivotal movement in a spherical recess provided in base member 2*a*. FIG. 9D shows another modification of armrest 1*a* where joint member 5*a* is directly fitted in a semi-spherical recess provided in base member 2*a*. In the latter, joint member 5*a* is urged at its top from above by cover 29 so that its pivotal movement can be controlled by the pressing force of cover 29. In FIG. 9D, the relation between the radius r of pivot 5*a* and the height h of forearm 200 rested on surface 83 is examined from the point of the stability of a device. Pivot 5*a* supporting forearm 200 on surface 83 tilted from the horizontal to an angle θ is shown. If the radius r of pivot 5*a*<the height h of forearm 200 is applied, the next equation is derived as follows.

$$r/(h-r)=\sin(\theta) \quad (1)$$

so that, the next equation is gained by equation 1.

$$r=h/(1+1/\sin(\theta)) \quad (2)$$

From equation 2, r=h/6.76 is derived, if θ=10 degree. If the next relation is hold, $$r>h/3 \quad (3)$$

cradle means 9*a* is very sable. Armrest 1*a* is small in the size and light in the weight. If joint member 5*a* increases its radius r greater than diameter D54 of support member 4*a*, it contributes to improve the durability of armrest 1*a*. If the next relation is hold on the contrary, $$r>h/3 \quad (4)$$

cradle means 9*a* has a very vivid operability of the forearm.

In pivotal mechanism 5*a* of the present invention, anti-slip member 38 is very important as anti-slip materials interposed between joint (universal joint) member 5*a* and platform 22*a* for improving the controllability of the forearm, the anti-slip effect, the rigidity of pivot movements and the absorption of unwanted irregular vibrations. A conventional pivot mechanism of ball-socket-joint or the ball-bearings are generally focused on the smooth rotary movements with minimum friction loss. Armrest 1*a* of the present invention is novel where anti-slip material 38 such as pressure sensitive adhesives is preferably interposed in the pivotal spaces for adding a resistance force to the pivotal movement thus to control the pivotal motion of cradle member 8*a*. Accordingly, the irregular wobbling movements of the conventional arm-support (which result in the no-rest use of muscles and nerves for accurately holding the spatial positions of the fingers) can substantially be eliminated and the RSI problems as a user-unfriendly apparatus will be overcome.

Rotary mechanism 6*a* may have post lower body 60 and its corresponding recess 55 formed by a hexagonal, or any polygonal shape in the cross-section or locked with a key for allowing no rotating movement. In that case, one rotational DOF of armrest motion is lost. Alternatively, when anti-slip member 38 is made of a pressure sensitive adhesive such as silicone gel, cradle means 9*a* enables the forearm supported thereon to be spun or operated without any trouble due to the soft elasticity of the gel material. More particularly, it is found that the forearm can more comfortably be controlled on armrest 1*a* in data-entry by keyboard when rotary mechanism 6*a* remains locked or is not provided.

Anti-slip member 38 may be selected a group from a group consisting of adhesive materials, pressure sensitive adhesives, plastics, synthetic resin, resilient materials, rubber adhesive materials containing natural or synthetic rubber, acrylic adhesive materials made by copolymerization of acrylic acid ester and functional monomer, polyether/polyurethane adhesive materials, natural resins such as birdlime, and gel materials such as silicone gel or porous silicone gel, or a combination thereof. In particular, silicone gel or porous silicone gel is preferable as having proper levels of the tackiness, the rigidity, and the resiliency and provides a vibration-damping effect at armrest 1*a*. Anti-slip member 38 can easily be cleaned by rinsing with water for repeated use when contact surface with joint member 5*a* is fouled.

Its preferable example is αGEL (TM of Geltec, Takanawa, Minato-ku, Tokyo, Japan). One of the physical properties of αGEL is shown below. The silicone gel comprises:

diorgano-polysiloxane as a green material of the silicone gel (referred to as A component hereinafter) expressed by the formula:

$$RR12SiO—(R22SiO)nSiR12R \quad (5)$$

(where R is an alkenyl group, R1 is a monovalent hydrocarbon group having no fatty unsaturated bonds, R2 is a monovalent fatty hydrocarbon group (R2 containing at least 50 mol % of methyl group and, if included, not higher than 10 mol % of alkenyl group), and n is such a numeral that the viscosity ranges from 100 to 100,000 cSt at 25° C.); and organohydrogen-polysiloxane (referred to as B component hereinafter) as a green material which has a viscosity of not higher than 5000 cSt at 25° C. and contains at least one hydrogen atom bonded directly to two silicon atoms in each molecule.

More specifically, the silicone gel is an addition reaction type silicone polymer generated by curing a mixture of the B component and the A component where the (molar) ratio of the alkenyl group in the A component to the amount of hydrogen atoms bonded directly to silicon atoms in the B component is 0.1 to 2.0.

In a compound structure of the silicone gel, the alkenyl groups R joined to both ends of a molecular chain of the A component are attached to the hydrogen atoms bonded directly to silicon atoms in the B component thus forming a bridge structure. The two alkenyl groups joined to the molecular chain are preferably lower alkenyl groups and more preferably vinyl groups for achieving higher reactivity. The group R1 at the molecular chain is a monovalent hydrocarbon group having no fatty unsaturated bond and may be selected from methyl groups, alkyl groups such as propyl or hexyl groups, phenyl groups, and fluoroalkyl groups.

The group R2 in Formula (5) is a monovalent fatty hydrocarbon group and may be selected from methyl groups, alkyl groups such as propyl or hexyl groups, and lower alkenyl groups such as vinyl groups. R2 however contains at least 50 mol % of a methyl group. When R2 is an alkenyl group, the compound contains preferably not higher than 10 mol % of the alkenyl group. If the alkenyl group exceeds 10 mol %, the bridge structure will be increased in density thus elevating the viscosity. The constant n is carefully adjusted so that the viscosity of the A component at 25° C. ranges from 100 to 100,000 cSt and preferably from 200 to 20,000 cSt.

The B component is a bridging agent for the A component which permits the hydrogen atoms bonded directly to silicon atoms to join with the alkenyl groups in the A component thus curing the A component. While the B component enables to perform the above reaction, its molecular structure may be of a chain form, an annular form, a network form, or any other appropriate form. In the B component, organic groups in addition to the hydrogen atoms are bonded to the silicon atoms and may be a lower alkyl group such as methyl group. Also, the viscosity of the B component at 25° C. is preferably not higher than 5,000 cSt and more preferably not higher than 500 cSt. Characteristic example of the B component are organohydrogen-polysiloxane having a molecular chain closed at ends with triorgano-siloxane groups, a copolymer of diorgano-siloxane and organohydrogen-siloxane, tetraorgano-tetrahydrogen-chcyclo-tetrasiloxane, a copolymer polysiloxane comprising HR12SiO 1/2 unit and SiO 4/2 unit, and a copolymer polysiloxane comprising HR12SiO 1/2 unit, R13SiO 1/2, and SiO 4/2 unit, where R1 is the monovalent hydrocarbon group having no fatty unsaturated bond. The A component and the B component are mixed and cured so that the ratio of the molar weight of hydrogen atoms bonded directly to silicon atoms in the B component to the molar weight of the alkenyl group in the A component ranges from 0.1 to 2.0 and preferably from 0.1 to 1.0.

The curing process may be carried out using a catalyst. The catalyst is preferably a palladium catalyst and may be selected from finely grained palladium, palladium chloride acid, palladium oxide, complex salt of palladium and olefin, palladium alcoholate, and complex salt of palladium chloride acid and vinyl siloxane. In mixture, the complex salt is not lower than 0.1 ppm (based on palladium as applied to all ppm measurements hereinafter) and preferably not lower than 0.5 ppm in the sum weight of the A component and the B component. The amount of the catalyst has no upper limit. When the catalyst is a liquid or a solution, 200 ppm or lower will be adequate.

As the mixture of the A component and the B component with the catalyst has been left at the room temperature or heated, they are cured to develop the silicone gel used in the present invention. The heating for curing may be carried out at a temperature ranging from 50° C. to 160° C. The silicone gel produced by the above manner has a penetration rate of 5 to 250 measured conforming to JIS K2207-1980 at loading of 50 g. The hardness of the silicone gel may vary depending on the characteristics of the bridge structure between the A component and the B component. The viscosity before curing and the penetration rate after curing of the silicone gel can be controlled by doping 5 to 75% by weight of silicone oil having methyl groups at its chain end.

The silicone gel may be either fabricated by the above described manner or purchased in the applicable market. Examples of the commercially available silicone gel include CF5027, TOUGH-3, TOUGH-4, TOUGH-5, TOUGH-6, TOUGH-7, and TOUGH-8 (of Toray Dow Coning Silicone), X32-902/cat1300 and KE1308/cat1300-L4 (of Shinetsu Chemical), and F250-121 (of Nippon Unica).

Also, other agents than the A component, the B component, and the catalyst may be doped such as a pigment, a retardant, a flame-retardant, or an electrically conductive filler without impairing the desired properties of the silicone gel. Furthermore, the silicone gel may be doped with a filler of minute hollow spherical forms for increasing the effect of anti-vibration and anti-impact. Characteristic examples of the filler are Fillite and Expansel (TM of Nippon Ferrite), and Matsumoto Microsphere (TM of Matsumoto Yushi).

The driving force for the pivotal movements of cradle means 9*a* may be adjusted by controlling the tackiness of anti-slip member 38 itself. The driving force for the pivotal movements between cradle means 9*a* (or joint member 5*a*) and base member 2*a* (or platform 22*a*) may be adjusted by changing the contact area-size and/or thickness of anti-slip member 38, or by modifying the accuracy of the surface finishing on curved-surface 51 and/or bottom 28. The higher the accuracy of the surface finishing such as mirror finishing, the greater the tackiness of anti-slip member 38 is increased as compared with wooden materials of which the surface is highly undulated. Anti-slip member 38 as pressure sensitive adhesives may offset variations in the finishing accuracy on the undulated or planer surfaces or in the assembly accuracy of the components. Even when the contact curved-surface 51 against bottom 28 is finished with the surface at a lower accuracy or assembled by bonding or abutting two crescent blocks finished at a lower accuracy, its unfavorable surface roughness maybe absorbed by anti-slip member 38 of 1 mm to 15 mm thick. Accordingly, the use of anti-slip member 38 is preferable for providing the smooth pivotal movement, hence contributing to the lower cost of armrest 1*a*.

Detachable member 26 as an anti-slip material for the entire structure of the armrest apparatus 1*a* may also be made of the same material as of anti-slip member 38 or the like. For providing a stronger level of the tackiness to secure the entire body to surface 110 of a desk, the material of detachable member 26 is preferably a urethane rubber, a vacuum suction member, or a magnetic material. An example of the urethane rubber is G-Base-2, and G-Base-Sheet (TM of G-Base Osaka, Japan). Particularly, G-Base-2 has a higher level of vibration absorbing capability at a small thickness while being highly light in the weight.

One of the physical properties of G-Base-2 is shown below. The urethane rubber material comprises:

a polyurethane elastomer is mixed with from 1% to 60% by volume of a minute hollow spherical materials, the mixture exhibits not smaller than 80% in the shock absorption rate, from 0.5 kg/cm$^2$ to 1.84 kg/cm$^2$ in the adhesivity, and from 0.4 g/cm$^3$ to 1 g/cm$^3$ in the specific gravity. The minute hollow spherical materials in the polyurethane elastomer are depressed and rebound repeatedly, like the action of a balloon, when urged by an external stress due to vibration or impact. This improves the impact absorbing capability and even when the thickness is decreased, its impact absorbing capability will not be declined. The vibration absorbing capability along z-axis will significantly be improved. Also, as the specific gravity is decreased, the overall weight will decrease. While the detachable member 26 itself has a level of tackiness, it requires neither any other bonding agent nor double-sided adhesive tape for bonding between the assembly and the table or desk, hence decreasing the number of steps as well as the overall dimensions and weight. When its minute hollow spherical material ranges from 10 $\mu$m to 100 $\mu$m in the diameter and from 0.01 g/cm$^3$ to 0.1 g/cm$^3$ in the specific gravity, the impact absorbing material of a reduced thickness remains high in the impact absorbing capability and will be favorable for reducing the overall weight. When the ASQR F scale ranges from 30 to 80, the impact absorbing capability on a semiconductor circuited board or the like will be ensured.

The polyurethane elastomer is of no limitation and may be a combination of polypropylene glycol and isocyanate ester doped with phthalic dioctyl. Most preferable is a viscous, elastic urethane rubber (G-Base-2) fabricated by doping a neutral urethane elastomer with a hardener to form a semi-bridge structure. The minute hollow spherical material is also of no limitation and may be selected from a non-organic group of glass balloon, silica balloon, silane balloon, carbon balloon, alumina balloon, and zirconium balloon and an organic group of phenol balloon and vinylidene chloride balloon. One of the most preferable materials is fabricated by doping a thermoplastic resin, such as vinylidene chloride or acrylonytryl, with an expander such as hydrocarbon and heating the mixture to soften the thermoplastic resin and evaporate the hydrocarbon for expansion (for example, Expansel, TM of Nippon Ferrite), which is small in the specific gravity and the weight and high in the impact absorbing capability.

The average size of the minute hollow spherical materials ranges preferably from 10 $\mu$m to 100 $\mu$m in diameter. More preferably, the upper limit may be 70 $\mu$m while the lower limit may be 30 $\mu$m. If the size is smaller than 10 $\mu$m, the minute hollow spherical material which repeats expansion and contraction like the action of a rubber balloon in the polyurethane elastomer may be declined in the impact absorbing capability. If the size is greater than 100 $\mu$m, the impact absorption capability may be declined at an increased thickness. The specific gravity of the minute hollow spherical material ranges preferably from 0.01 kg/cm$^3$ to 0.1 g/cm$^3$ More preferably, the upper limit may be 0.07 g/cm$^3$ while the lower limit may be 0.02 g/cm$^3$. If the specific gravity is smaller than 0.01 g/cm$^3$, the physical strength will be declined. When mixed with the polyurethane elastomer, the minute hollow spherical material becomes susceptible to fracture. If the specific gravity exceeds 0.1 g/cm$^3$, the weight will hardly be decreased.

The dosage of the minute hollow spherical material to the polyurethane elastomer ranges preferably from 1% to 60% by volume. The upper limit of the dosage may be preferably 55% and more preferably 52%. The lower limit may be 5% and more preferably 10%. If the dosage is lower than 1%, the impact absorption capability will be too low. If the dosage exceeds 60%, the production cost will increase and the mixing process with the polyurethane elastomer will be difficult. The impact absorption capability is preferably not smaller than 80% and more preferably 90% or higher. If smaller than 80%, the vibration absorbing capability will be too low. The tackiness ranges preferably from 0.5 kg/cm$^2$ to 1.84 kg/cm$^2$ and more preferably from 1 kg/cm$^2$ to 1.84 kg/cm$^2$.

If the tackiness is smaller than 0.5 kg/cm$^2$, the armrest apparatus may hardly be secured. If over 1.84 kg/cm$^2$, the armrest may be detached with difficulty once secured and its handling will be troublesome. The specific gravity ranges preferably from 0.4 g/cm$^3$ to 1 g/cm$^3$. If smaller than 0.4 g/cm$^3$, the ratio of the minute hollow spherical material to the polyurethane elastomer may be too high to be mixed up. If over 1 g/cm$^3$, it may hardly be decreased in the weight. The hardness of the impact absorbing material ranges preferably from 30 to 80 in the ASQR F scale. If smaller than 30, the material may be too soft to be cleaned off and its handling will be troublesome. Also, the impact absorbing capability may be declined. If the material exceeds 80 in the hardness, it may be too stiff to maintain its impact absorbing capability to a desired level.

The impact absorbing material may be fabricated by the following method. The method starts with doping the hardener for polyurethane elastomer with a desired amount of the minute hollow spherical material and mixing the minute hollow spherical material doped hardener with a main material. After the mixture is shaped to a sheet form of a desired thickness, it is maintained at an appropriate temperature (e.g. 70 to 90° C.) for a predetermined length of time (e.g. two to four hours). As having been cured, the mixture is turned to an impact absorbing material.

The impact absorbing material is used as anti-slip member 26 for adhering or securing armrest 1*a* to the desk. This allows armrest 1*a* to be also detached with ease. The other components except the adhesive members of armrest 1*a* may be made of flexible materials and/or elastic materials.

As shown in FIGS. 1B and 9A, the fore arm is supported by surface 83 held horizontally with pivotal mechanism 5*a* where anti-slip member 38 is pressed downwardly by curved-surface 51 so that its center is slightly sunk lower than its edge portion. Simultaneously, a counter force from anti-slip member 38 to curved-surface 51 is concentrically applied for balancing. While curved-surface 51 concentrically receives the counter force from anti-slip member 38, unwanted vibrations transmitted from the forearm can be absorbed by anti-slip member 38 made of a gel material such as silicone gel. As shown in FIG. 1B, detachable member 26 at the bottom of armrest 1*a* receives uniform counter forces from surface 110 of the desk as denoted by the arrow-marks and remains in a balance.

When surface 83 with the forearm is tilted at an angle θ from z-axis as shown in FIG. 1C, pivotal mechanism 5*a* causes curved-surface 51 to urge the left half of anti-slip member 38. Accordingly, the left half of anti-slip member 38 is narrowed by the pressure, while the right half of it expands upwardly. As the elasticity of anti-slip member 38 urges curved-surface 51 to return to its original position shown in FIG. 1B, it constantly acts as a light braking or correcting force via curved-surface 51 against all the 3-D angular rotations of the forearm on surface 83 including pivoting or twisting motions (while the predictable control of yaw, pitch, and roll motion can be ensured by pivot 5*a*).

Also, the elasticity consistently develops a restoring force for returning back to the original horizontal position, hence giving a level of stability and rigidity. Anti-slip member 38 made of the gel material such as silicone gel provides a motion follow-up capability due to its fluidity, thus increasing the predictable operability in the local translation motion or revolution motion. As the gel material is highly elastic, its action can successfully absorb unwanted irregular movements of the forearm. As shown in FIG. 1C, detachable member 26 adhered to the lower surface of platform 22*a* receives a uniform counter force along z-axis, which is substantially equivalent to the counter force shown in FIG. 1B.

Accordingly, the pivotal mechanism 5*a* automatically converts with the anti-slip member 38 from the irregular movements of fingers (i.e. typing a keyboard) into stress releasing movements over the forearm without impairing a specific part of the wrist, whereby RSI can hardly be invited on the upper torso, nerves, and muscles. Also, anti-slip member 38 gives a proper degree of rigidity to pivotal mechanism 5*a*, this allows no drifting of the fingers, improves the repeatability of the finger position, and provides a comfortable rest means. While anti-slip member 38 and detachable member 26 are identical to each other in the properties of their material, they need different functions. It is hence desired that the characteristic of anti-slip member 38 is relatively high in the fluidity for ensuring a level of the follow-up capability to the movements of the forearm. It is also desirable to exhibit favorable characteristics for offsetting errors in the production or assembly accuracy and absorbing unwanted irregular vibrations during the movement. On the other hand, detachable member 26 is preferably high in the tackiness for increasing the anti-slip effect while having a desired level of the vibration absorbing capability.

Figure 14A:
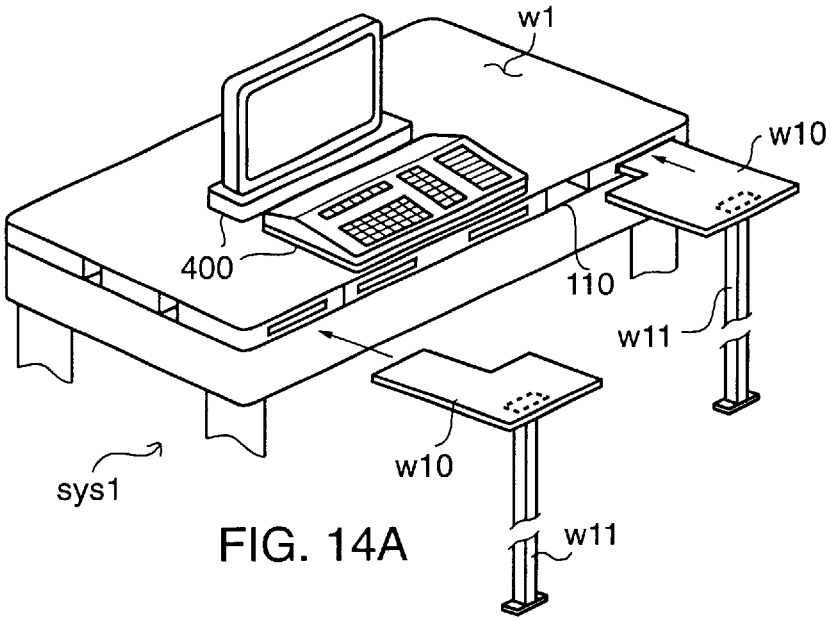
FIG. 14A is a perspective view of the entire desk-system.
Figure 14B:
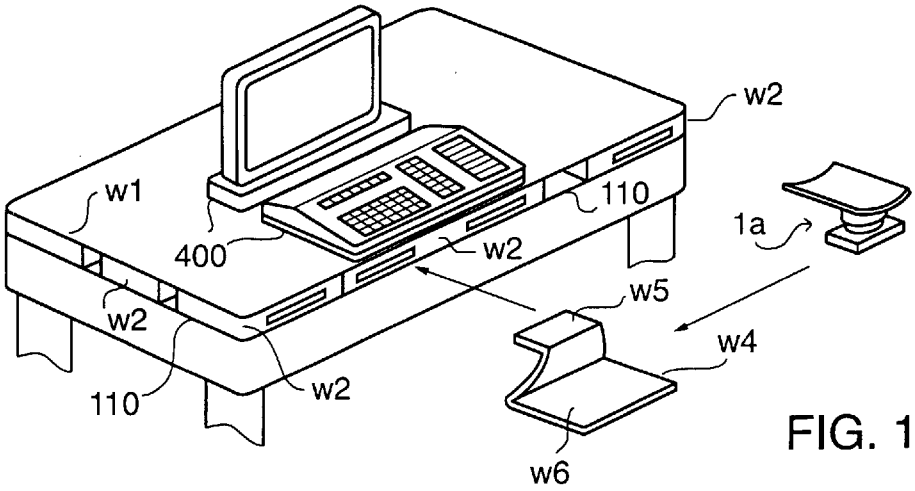
FIG. 14B is a perspective view of the entire desk-system engaged with armrest 1*a*.
Figure 14D:
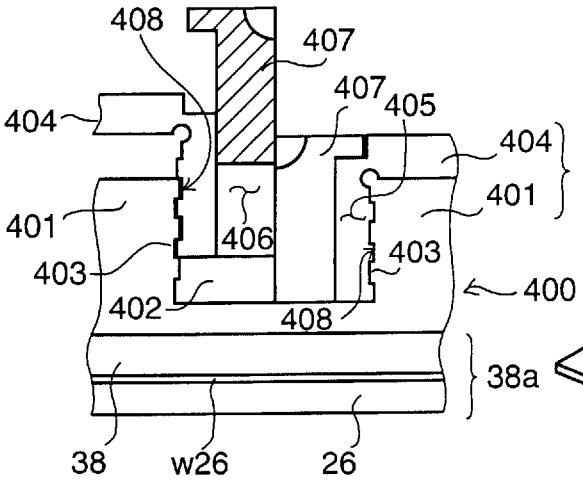
FIG. 14D is an explanatory view showing a height control means.
Figure 14C:
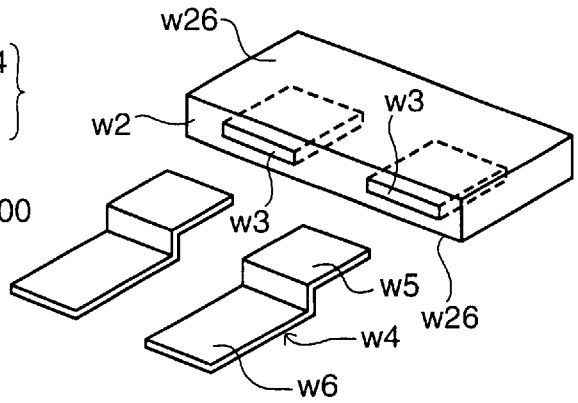
FIG. 14C is an explanatory view showing a hook-like thin plate w4 detachably engaging with a retaining member w2.

A modification of the embodiment of the present invention may be shown in FIG. 14D, where platform 22*a* is replaced by platform 400 and two adhesive members 38 and 26 are replaced by a single adhesive material 38*a*. Adhesive material 38*a* is layered by joining two or more pressure sensitive adhesives and/or elastic materials, which are equal or different in the tackiness, into a lamination or layer assembly, thus minimizing the number of relevant components.

Another embodiment of the present invention will be described in the form of a kit of the armrest apparatus 1*a*. The kit comprises base member 2*a* detachably installed on surface 110 of a desk, a cradle means 9*a* for supporting the forearm of a user, an anti-slip member 38 interposed in a pivotal space between base member 2*a* and cradle means 9*a*, and a detachable member 26 detachably adhered to the bottom of base member 2*a*. Base member 2*a* of the kit can be separated into a platform 22*a* and a cover 29*a*. Cradle means 9*a* of the kit can also be separated into a support member 4*a* and a cradle member 8*a*, and support member 4*a* of the kit can further be separated into a joint member 5*a*, a post member 41 and an engaging means 7*a*.

The components of the kit 1*a* can be assembled in the following steps. The assembly method includes picking up platform 22*a* from the kit (step D1), mounting anti-slip member 38 on the upper recess of platform 22*a* (D2), connecting directly joint member 5*a* with base member 2*a* (D3), and joining thread between cover 29*a* and platform 22*a* (D4). After a step of rotatably fitting an engaging means 7*a* of upper support member 4*a* with joint member 5*a* (D5) a step of fitting or engaging cradle member 8*a* with engaging means 7*a* (D6) is done. From step D1 to D6, pivotal mechanism 5*a* is formed by directly connecting to base member 2*a* and cradle means 9*a*.

After the steps of adhering detachable member 26 at one side to the bottom of platform 22*a* (D7), and mounting the other side of detachable member 26 on the surface of a desk (D8), the assembly process is completed. From step D7, the assembly of armrest 1*a* is completed, and from step D8 the installation of armrest 1*a* is completed.

In case of dismounting armrest 1*a* from surface 110, it is very easy, grip base member 2*a* by hand, then slowly lift it up. That is all.

The components of the kit 1*a* can be assembled in another following steps. The assembly method includes picking up platform 22*a* from the kit (step E1), adhering detachable member 26 at one side to the bottom of platform 22*a* (E2), and mounting the other side of detachable member 26 on the surface of a desk (E3). The steps follow mounting anti-slip member 38 on the upper recess of platform 22*a* (E4), engaging or mounting joint member 5*a* on anti-slip member 38 (E5), and thread joining between cover 29*a* and platform 22*a* (E6). After the steps of rotatably fitting an engaging means 7*a* of upper support member 4*a* with joint member 5*a* (E7) and fitting or engaging cradle member 8*a* with engaging means 7*a* (E8), the second assembly method of armrest apparatus 1*a* is completed.

Another installation of armrest apparatus 1*a* will now be described.

F1) When armrest 1*a* is available in its assembled form, the following procedure is conducted before delivery.

The procedures (E1, E2, and E4 to E8) include a process of mounting cradle means 9*a* (which includes a cradle member 8*a* on which a portion close to the wrist of the forearm of a user is held) directly on base member 2*a* (which is detachably installed directly on the surface of a desk. This forms a pivotal mechanism 5*a* (which is pivotable along the curved-surface of a predetermined shape) between cradle means 9*a* and base member 2*a* and the forearm can be varied in the height along z-axis by the action of cradle means 9*a* while controlled for pivotal movements by pivot 5*a*. At the time, detachable member 26 remains covered at one side with a protective sheet.

After armrest 1*a* is purchased by a user, detachable member 26 is exposed at the bottom by removing the protective sheet. The armrest 1*a* is installed on the surface of a desk by the tackiness of detachable member 26 to a desired location of the surface (E3 of the above described steps). Then, the installation of armrest 1*a* is completed.

F2) When armrest 1*a* is available in the form of a kit which has to be assembled by a user, the following steps are needed.

The steps include picking up platform 22*a* from the kit (E1), after removing a protective sheet from detachable member 26, adhering detachable member 26 at one side to the bottom of platform 22*a* (E2), and after removing another protective sheet from detachable member 26 adhering the other side of detachable member 26 to the surface of a desk (E3). A preparatory procedure for directly installing base member 2*a* at a desired location on the surface of a desk is now completed.

The steps then follow, after removing protective sheets from both sides of anti-slip member 38, mounting anti-slip member 38 on the upper recess of platform 22*a* (E4), further mounting joint member 5*a* on anti-slip member 38 (E5), and thread joining between cover 29*a* and platform 22*a* (E6). After the steps of rotatably fitting an engaging means 7*a* of upper support member 4*a* with joint member 5*a* (E7) and fitting or engaging cradle member 8*a* with the engaging means 7*a* (E8), the assembly procedure of armrest 1*a* is completed.

Accordingly, cradle means 9*a* is directly mounted on base member 2*a* to form directly pivotal mechanism 5*a* along curved-surface 51 of a predetermined shape, whereby the forearm rested on cradle member 8*a* can be varied in the height along z-axis and controlled for pivotal movement by the action of cradle means 9*a*.

F3) The steps described in F1 and F2 for directly mounting cradle means 9*a* onto bottom 28 of base member 2*a* may preferably be added with a step of providing an anti-slip member 38 between cradle means 9*a* and base member 2*a*. Anti-slip member 38 maybe selected from at least adhesive materials, pressure sensitive adhesives, synthetic resins, elastic materials, synthetic or natural rubbers gel materials, silicone gel materials, and porous silicone gel materials. Preferably, the material of anti-slip member 38 is a pressure sensitive adhesive or namely a silicone gel material. Also, detachable member 26 is provided on the bottom of base member 2*a* for ease of detachably installing armrest 1*a* on the surface of a desk. Cradle member 8*a* may detachably be joined to engaging means 7*a* of upper support member 4*a*. More specifically, cradle member 8*a* is detachably inserted, fitted, abutted, or assembled at engaging projections 82 with engaging means 7*a* for forward and backward movement to adjust its position. Moreover, engaging means 7*a* of support member 4*a* is detachably joined by rotary mechanism 6*a* of post member 41 to joint member 5*a*. This allows cradle means 9*a* to be adjusted in the height by changing a vertical length of post member 41. Alternatively, a slidable engaging means (as shown in FIG. 14D) may be provided on post member 41 for adjusting the height of cradle means 9*a*.

Cover 29*a* having a through opening 295 provided in the upper side thereof and acting as a restricting means for restricting the pivotable range of cradle means 9*a* may be thread joined by a pair of threads 291 and 292 to platform 22*a* of base member 2*a*. A shock absorber member made of a gel material, an urethane material, and/or an elastic material may also be attached to the inner side of cover 29*a* where it touches joint member 5*a* or outer side 52 of joint member 5*a* for attenuating the sound of collision between cover 29*a* and joint member 5*a*.

FIG. 6 related to FIG. 2 illustrates another armrest apparatus 1*b* according to the present invention where a cradle means 9*b* is mounted directly on a desk with the use of no base member, and a cradle member 8*b* is accompanied with a slidable (transfer) mechanism 7*b* arranged rotatable and slidable in one direction. While like components are denoted by like numerals as those of the previous embodiment, transfer mechanism 7*b* may comprise permanent magnet 75*b* and rollers 72*b* for joining with cradle member 8*b*. As illustrated, armrest 1*b* comprises a smaller number of the components and can be controlled for pivotal movements and sliding movement. More particularly, armrest 1*b* comprises a support member 4*b* and cradle member 8*b*. Support member 4*b* incorporates a pivotal mechanism 5*b*, a thread mechanism 6*b*, and a transfer mechanism 7*b*. Cradle means 9*b* has an angular control mechanism which comprises pivotal mechanism 5*b* of curved-surface 51 and rotary mechanism 6*b*.

The structure of armrest 1*b* of the present invention will be described in more detail referring to FIG. 6. Armrest apparatus 1*b* comprises cradle means 9*b* which includes cradle member 8*b* accompanied with transfer mechanism 7*b* for transferring the forearm and cradle member 8*b* linearly, and the angular control mechanism of pivot 5*b* and rotary thread 6*b*. Support member 4*b* inplanted anti-slip members 38 at curved-surface 51 is directly mounted on surface 110 of a desk for pivotal movements. The pivotable range of cradle means 9*b* maybe restricted by a restricting means 129 which is detachably mounted by a detachable member 26 on surface 110. Support member 4*b* and cradle member 8*b* are engaged with each other by transfer mechanism 7*b* acting as a linear transfer mechanism for sliding movements of cradle 8*b*. Accordingly, the location and angular attitude of the forearm while supported in the air by cradle means 9*b* can be controlled for pivotal movements and translation motion to operate a mouse or keyboard. As no base member is provided on surface 110, support member 4*b* is directly mounted at its lowermost end to surface 110.

The structure of cradle means 9*b* will be explained in more detail. As support member 4*b* shown in FIG. 6 comprises joint member 5*b*, thread mechanism 6*b* also serving as a rotary mechanism, and transfer means 71*b* for slidably moving cradle member 8*b* in substantially forward and backward directions, it acts as an angular control mechanism for controlling the angular attitude of cradle means 9*b*. Support member 4*b* and cradle member 8*b* are detachably joined to each other by transfer mechanism 7*b*. As shown in FIG. 6, joint member 5*b* as a lower section of support member 4*b* has a plurality of anti-slip members 38 provided on curved-surface 51 and is hence mounted by anti-slip members 38 on surface 110 of a desk. Another embodiment of anti-slipmember 38 related to support member 4*b* is explained later in FIG. 11C.

While joint member 5*b* also has cylindrical recess 55 provided in an upper side thereof, a female thread is provided at recess 55 for thread engagement with a male thread provided in a lower portion of transfer means 71*b*. The threads constitute thread mechanism 6*b* which acts as a rotary mechanism for turning cradle member 8*b*, and a height control mechanism for adjusting the length of support member 4*b*, equivalent to the height of surface 83 of cradle member 8*b*. As transfer means 71*b* with the male thread is mounted on the upper end of support member 4*b* for linearly transferring cradle member 8*b*, it is also provided at its four locations (front, rear, left, and right sides) to transfer wheels 72*b* by appropriate tightening means 73*b* such as eccentric screws. Transfer means 71*b* has a recess provided in the upper side thereof where a high coercive magnetic material 75*b* is accommodated by adhesives.

Figures 6A, 6B, 6C, 6D, 6E, 6F:
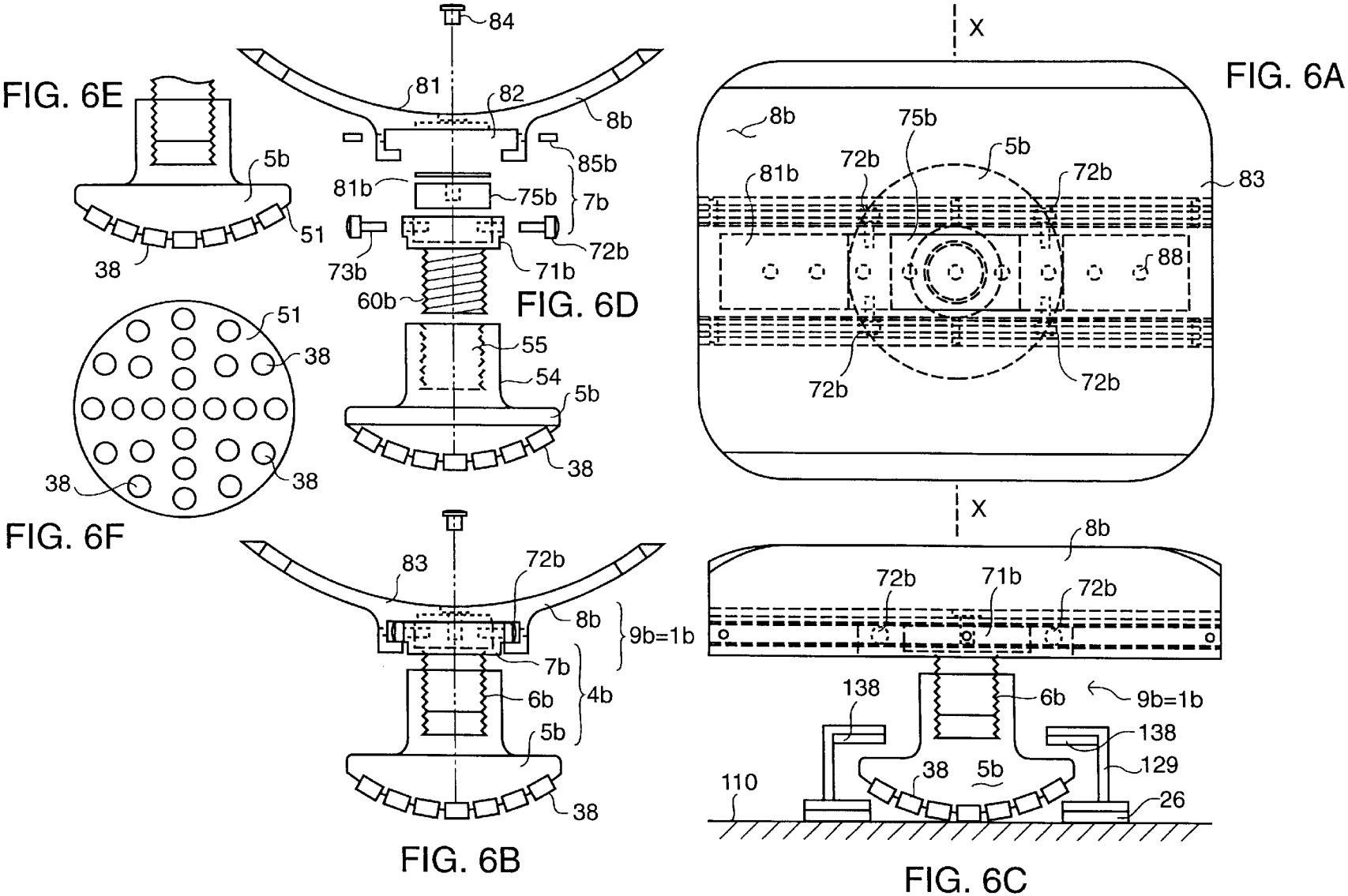
FIG. 6A is a plan view of armrest 1*b* and FIG. 6B is a sectional view taken along line X—X of FIG. 6A.
FIGS. 6C and 6D are a side view and an exploded front view of the same.
FIGS. 6E and 6F are a front view and a bottom end view of pivotal mechanism 5*b*.

Cradle member 8*b* has a recess 82 of a C-shape in cross-section provided in the lower side thereof for engagement with transfer means 71*b*. This allows cradle member 8*b* can slide linearly over transfer means 71*b*. More particularly, a shallowly recessed transfer runway 81*b* is provided at recess 82 in the lower side of cradle member 8*b*. As trip of high coercive magnetic guiding material is accommodated in transfer runway 81*b* and tightened to the lower side of cradle member 8*b* by tightening screws 84 inserted from surface 83. As best shown in FIG. 6D, the head of each eccentric screw 73*b* acts as a jogging preventing guide for transfer wheels 72*b* along recess 82 so that cradle member 8*b* can travel without largely dislocating in the leftward and rightward directions. Alternatively, for preventing cradle member 8*b* from dislocating in the longitudinal direction while running on transfer wheels 72*b*, guiding recesses for transfer wheels 72*b* may be provided in the guiding material in transfer runway 81*b* or steps may be formed between recess 82 and transfer runway 81*b*.

Accordingly, transfer runway (the guiding material) 81*b* and transfer means 71*b* constitute in a combination linear slidable transfer mechanism 7*b*. Also, magnetic force of transfer means 71*b* for attracting transfer runway 81*b* may be controlled by varying the surface area of magnetic material 75*b* or the distance between transfer runway 81*b* and magnetic material 75*b*, e.g. changing the diameter or the location of transfer wheels 72*b*. The guiding material in transfer runway 81*b* is tightened to the lower side of cradle member 8*b* by tightening members 84 from surface 83 side. When tightening members 84 extend into recess 82, they can act as restricting means for transfer means 71*b*. When the guiding material in transfer runway 81*b* has lock holes 88 provided at equal intervals therein, lock pin can be inserted from surface 83 side into lock holes 88 to lock the sliding movement of cradle member 8*b*. It is also possible for locking the sliding movement of cradle member 8*b* to use lock pin 85*b* for inserting into lock holes formed in both sides of transfer means 71*b* across corresponding holes formed in the lower part at recess 82. Lock means of transfer mechanism 7*b* comprises lock holes 88 and lock pin 85*b*.

Accordingly, while cradle member 8*b* guided with transfer runway 81*b* is coupled to transfer means 71*b* by gravity of the forearm and attraction-force of magnetic material 75*b*, it can slide and travel on transfer wheels 72*b* of transfer means 71*b*. Linear transfer mechanism 7*b* may be replaced with a slide rail mechanism (FBW2560R, TM of THK, Shinagawa Tokyo, Japan), non-contact transfer mechanism such as air slider system, or any other appropriate mechanism when desired.

Armrest apparatus 1*b* having cradle means 9*b* arranged rotatable and pivotable with slide traveling (transfer) mechanism 71*b* allows the forearm of a user supported in cradle member 8*b* to be arbitrarily controlled by the action of curved-surface 51 in three or more rotational DOFs, particularly so that the height of surface 83 can be changed, while remaining held from below by the action of cradle means 9*b*, and smoothly transferred longitudinally by the action of transfer wheels 72*b* of transfer means 71*b*. When cradle means 9*b* is not in service, it can easily be dismounted and removed. Anti-slip member 38 may be selected from at least a group consisting of adhesive materials, pressure sensitive adhesives, synthetic resins, synthetic rubbers, natural rubbers, and gel materials. Its material is preferably a synthetic rubber material such as a urethane rubber.

A modification of armrest 1*b* will be explained referring to FIG. 6C where the pivotable range of cradle means 9*b*directly installed on surface 110 of a desk is restricted by restricting means 129 adhered with detachable member 26 to surface 110. In action, restricting means 129 adhered with a shock absorbing material 138 to inside is in direct contact with the pivotal surface of cradle means 9*b* thus to restrict pivotal movement of the same. This permits armrest 1*b* to serve as a comfortable rest means with the tackiness of detachable member 26 when a user feels tired and stops its action after a long period of working. As cradle means 9*b* is held at a desired angular attitude by the effect of restricting means 129, it supports the forearm at higher stability. Accordingly, cradle means 9*b* can successfully be controlled for spatial positioning at rest period with no use of muscles or nerves. Also, while armrest 1*b* is rigid enough to sustain the weight of a user, the conventional arm support which has a known linkage for holding a cradle may be unstable or wobbled along the horizontal direction and hardly used as a comfortable rest means when the user feels fatigue after a long period of operations but with need of muscles or nerves for controlling the drifting motion in a given space, hence being unfavorable for conducting the fatigue-free operation.

Figure 7A:
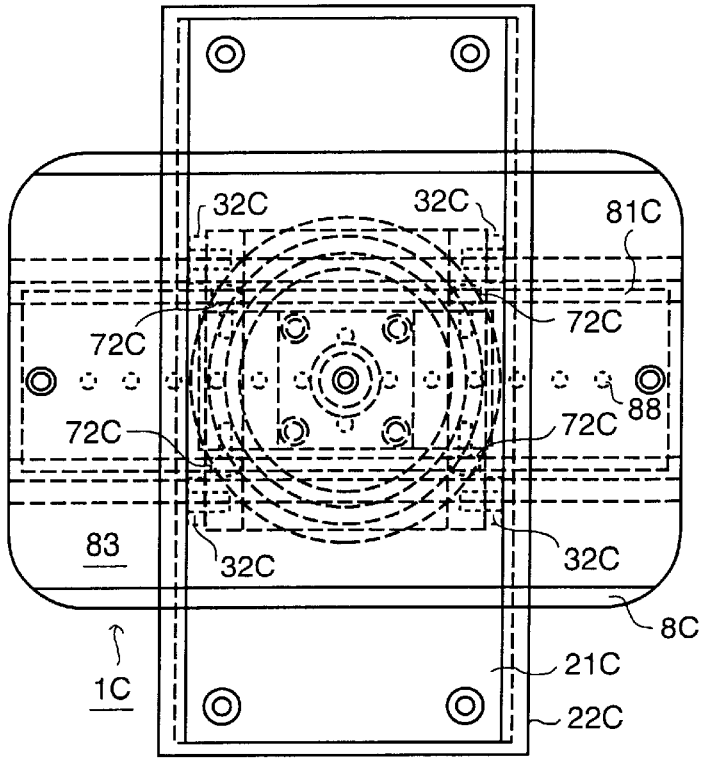
FIG. 7A is a plan view of armrest 1*c*.
Figure 7B:
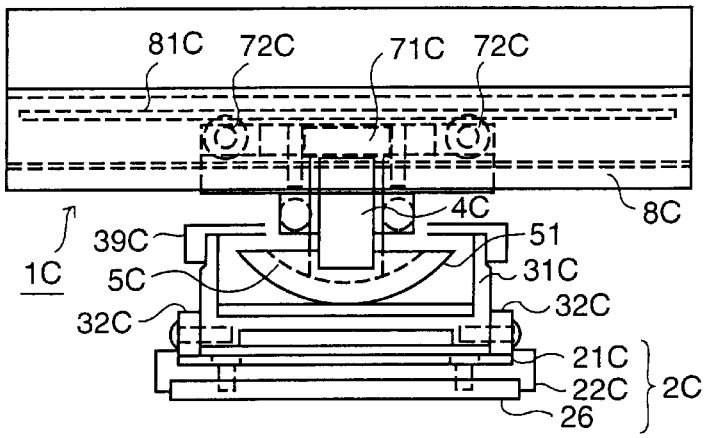
FIGS. 7B and 7C are a side view and a front view of the same.
Figure 7C:
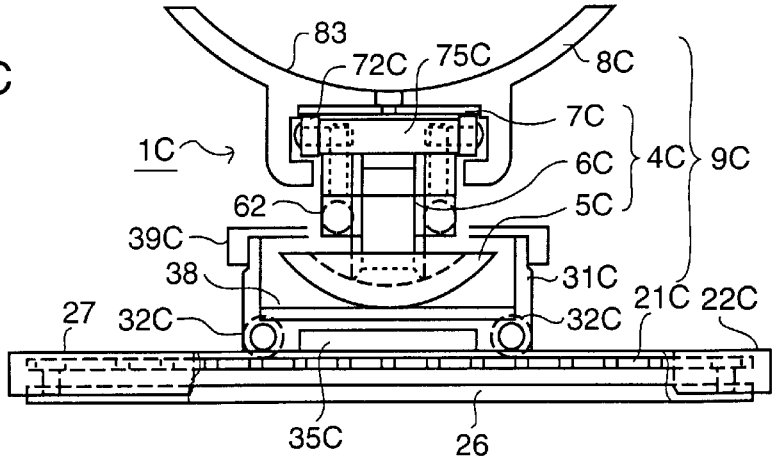
Figures 8A, 8B, 8C, 8D, 8E, 8F, 8G, 8H, 8J, 8K, 8M, 8N:
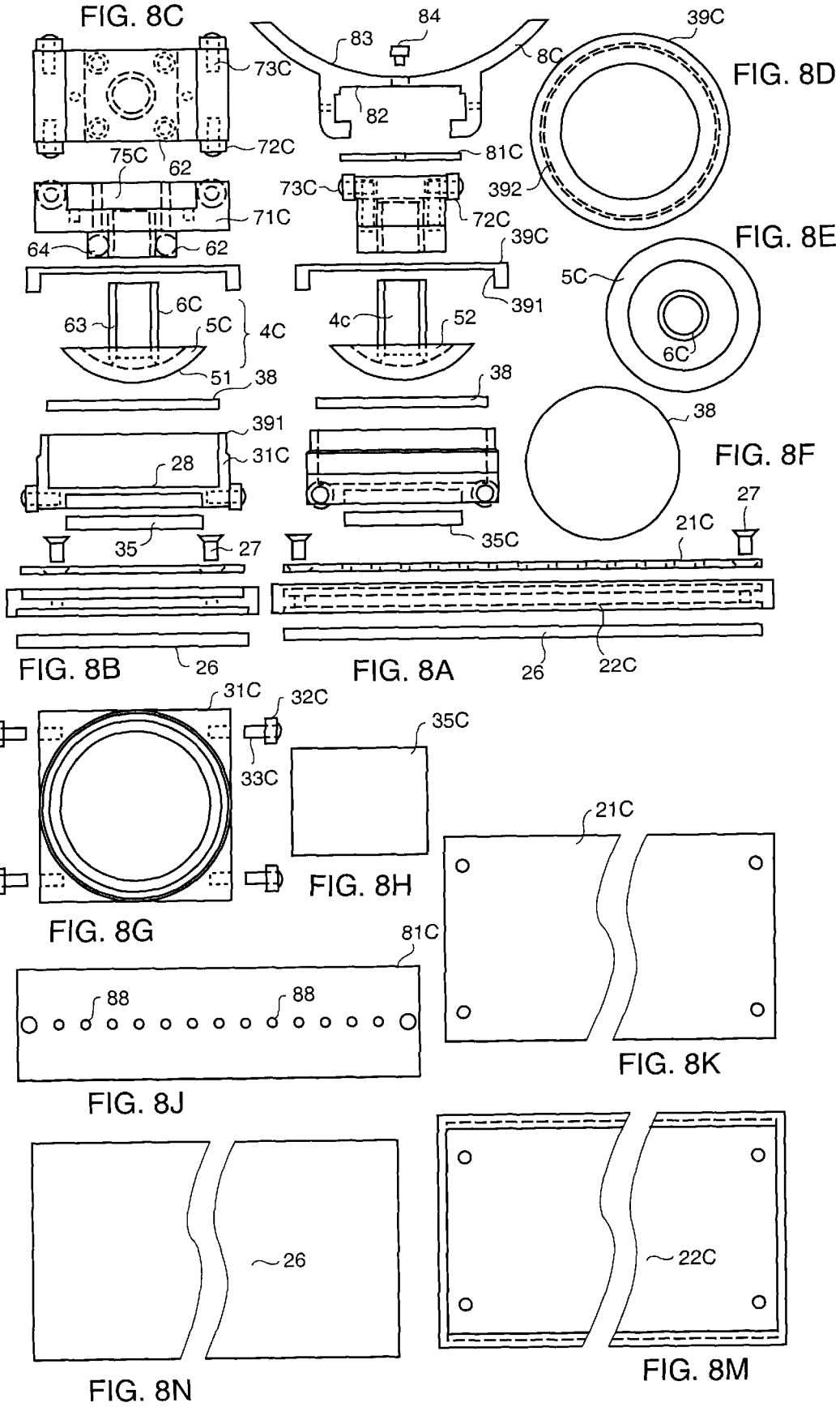
FIG. 8A is an exploded front view of armrest 1*c* and FIG. 8B is an exploded side view of the same.
FIG. 8C is a plan view of second transfer means 71*c*.
FIG. 8D is a plan view of cover 39*c* for first transfer means 31*c*.
FIG. 8E is a plan view of joint member 5*c*.
FIG. 8F is a plan view of anti-slip member 38.
FIG. 8G is a plan view of first transfer means 31*c*.
FIG. 8H is a plan view of a magnet for transfer means 31*c* and 71*c*.
FIG. 8J is a plan view of second runway 81*c*.
FIG. 8K is a plan view of first runway 21*c*.
FIG. 8M is a plan view of base member 2*c*.
FIG. 8N is a plan view of detachable member 26.

FIGS. 7 and 8 related to FIGS. 2 and 6 illustrate an armrest apparatus 1*c* according to the present invention where a cradle means 9*c* has two linear transfer mechanism arranged slidable in two different directions. Like components are denoted by like numerals as those of the previous embodiment. In particular, first transfer mechanism 3*c* and second transfer mechanism 7*c* are coupled to each other rotatably and pivotably. Also, runway 21*c* is short enough to hold armrest 1*c* at each side. Armrest 1*c* comprises base member 2*c* and cradle means 9*c*. Cradle means 9*c* consists mainly of, from below, first transfer mechanism 3*c*, pivotal mechanism 5*c*, rotary mechanism 6*c*, second transfer mechanism 7*c*, and cradle member 8*c*. Pivotal mechanism 5*c* and rotary mechanism 6*c* of cradle means 9*c* constitute an angular control mechanism in a combination.

The arrangement of armrest 1*c* is explained in more detail. Armrest 1*c* comprises mostly first runway 21*c* elongated longitudinally on base member 2*c* which is detachably mounted on surface 110 of a desk and cradle means 9*c* arranged movable with running wheels (rollers) 32*c* along first runway 21*c*. Cradle means 9*c* consists mainly of first transfer mechanism 3*c* of a roller-type also acting as a linear transfer mechanism including a transfer means (carriage) 31*c* for linear movement, joint member 5*c* having curved-surface 51 thereof mounted on bottom 28 of first transfer means 31*c* for pivotal movement, support member 4*c* including rotary and thread mechanism 6*c* and transfer means (table) 71*c*, and cradle member 8*c* having second transfer mechanism 7*c* with a runway 81*c* slidably carried on transfer table 71*c*. Armrest 1*c* allows the forearm of a user mounted on cradle member 8*c* to be controlled by the action of cradle means 9*c* for pivotal and rotary movements and sliding movements in leftward, rightward, forward, and backward directions.

First runway 21*c* shown in FIG. 7 is combined with first transfer means 31*c*, support member 4*c*, and cradle means 9*c* including cradle member 8*c*. In case that two hands of a user are used, two sets of armrest 1*c* may be provided at left-side and right-side for positioning with different angles. Alternatively, runway 21*c* may be joined with two or more of cradle means 9*c*. In action, while the forearm mounted on cradle member 8*c* is pivotably held in a given space for operating a mouse or keyboard, it can arbitrarily be changed in the height with pivot operation of cradle means 9*c* in three or more rotational DOFs over curved-surface 51 to determine its location (x, y, z) and angular attitude ($\alpha$ $\beta$ $\gamma$)

Each section of armrest 1*c* is explained in more detail. Base member 2*c* arranged detachable has a platform 22*c* of a long narrow, plane-like form elongated longitudinally on surface 110 of the desk, as shown in FIG. 7. Detachable member 26 is attached or adhered as an anti-slip means to the bottom of platform 22*c* so that base member 2*c* can directly be adhered or mounted on surface 110. The location of base member 2*c* on surface 110 may preferably be at an intermediate space between the location of data entry device and the location of a user. First runway 21*c* of a magnetic material is accommodated in a recess provided in the upper side of platform 22*c* to elongate longitudinally and tightened at both ends to platform 22*c* by tightening members 27. Transfer means 31*c* with rollers 32*c* secured by eccentric bolts 33*c* is slidably mounted on runway 21*c*. As shown in FIG. 7B, running wheels 32*c* are guided with the side walls at the recess of platform 22*c* for diminishing or minimizing the forward and backward dislocation of transfer means 31*c* which travels in the leftward and rightward directions. Runway 21*c* and transfer means 31*c* thus constitute linear transfer mechanism 3*c* of a roller-type.

First transfer means 31*c* movable longitudinally is arranged of a four-sided box-like shape having a lower recess provided in the lower side thereof corresponding to runway 21*c*. First transfer means 31*c* also has an upper recess of a round shape provided in the upper side of a cylindrical portion thereof. Cover 39*c* having a through opening provided in the center thereof is mounted by threading onto the cylindrical portion of first transfer means 31*c*. Four of running wheels 32*c* are fixedly attached by eccentric screws 33*c* to the four lower end corners of first transfer means 31*c*. In particular, a high coercive magnetic member 35*c* such as an permanent magnet is detachably adhered to the lower side of first transfer means 31*c* for magnetically attracting between transfer means 31*c* and runway 21*c* while anti-slip member 38 of a disk shape made of a silicone gel or the like is detachably mounted on bottom 28 at the upper recess of transfer means 31*c*. First transfer means 31*c* and cover 39*c* are threaded to each other by the action of thread mechanisms 391 and 392 respectively.

When cover 39*c* is disposed above anti-slip member 38 as a part of support member 4*c*, it provides a dust-proof function and acts as a restricting means (stopper) for restricting pivotable range of joint member 5*c*. Preferably, cover 39*c* is covered at its inner side with an elastic material such as urethane resin or a gel material for attenuating the sound of collision between cover 39*c* and joint member 5*c*. Anti-slipmember 38 supports from below directly curved-surface 51 of joint member 5*c* formed with a part of a sphere so that joint member 5*c* can be rotated pivotably. Bottom 28 of transfer means 31*a*, anti-slip member 38, and joint member 5*c* constitute pivotal mechanism 5*c*. It is found through a series of experiments that the disk size of anti-slip member 38 is preferable when its radius is substantially less or equal to ½ the horizontal radius of curved-surface 51.

The magnetic attraction force of transfer means 31*c* over runway 21*c* or base member 2*c* may be controlled by changing the surface area of magnetic member 35*c* or the diameter or the fixing location of wheels 32*c* to adjust the distance between magnetic member 35*c* and runway 21*c* or varying the magnetic permeability of magnetic material of runway 21*c*. Also, as eccentric screws 33*c* are turned to a specific degree, wheels 32*c* retract upward hence causing transfer means 31*c* to come in direct contact with runway 21*c*. Accordingly, eccentric screws 33*c* may be used as a lock means for locking the movement of transfer means 31*c*.

Support member 4*c* comprises an angular control mechanism (a combination of joint member 5*c* and thread mechanism 6*c*) and second transfer means (table) 71*c*. Joint member 5*c* and second transfer means 71*c* are detachably joined to each other by thread mechanism 6*c* for rotating movement. More specifically, joint member 5*c* is pivotably mounted at curved-surface 51 directly on anti-slip member 38 seated on bottom 28 at upper recess of first transfer means 31*c* so that support member 4*c* and first transfer means 31*c* serve as pivotal mechanism 5*c*. Joint member 5*c* has a male thread 63 provided in an upper cylindrical portion thereof. Male thread 63 is threaded in to a female thread 64 provided in the inner wall of second transfer means 71*c* (of a hollow cylindrical shape), hence forming thread mechanism 6*c*. Thread mechanism 6*c* acts as a rotary mechanism operable between joint member 5*c* and second transfer means 71*c* or cradle member 8*c* and simultaneously as a height control mechanism for adjusting the height of surface 83.

The combination between bottom 28 of transfer means 31*c* and curved-surface 51 may be selected from a set of six combinations shown in FIGS. 10A to 10F.

Second transfer means 71*c* which is an inverted form of first transfer means 31*c* is joined to the upper end of thread mechanism 6*c* by tightening members 62 (which maybe formed integral with transfer means 71*c*) and acts as transfer table for cradle member 8*c*. Four transfer wheels 72*c* are fixedly attached to four corners of transfer means 71*c* by tightening members 73*c* such as eccentric screws. Transfer means (table) 71*c* has a recess provided in the upper side thereof for accommodating a high coercive magnetic material (a permanent magnet) 75*c*. Thread mechanism 6*c* joined to second transfer means 71*c* has a projection 65 provided on the lowermost end thereof while joint member 5*c* has a recess 52 provided therein corresponding to thread mechanism 6*c*. When projection 65 is fitted into recess 52, the height of cradle member 8*c* can be controlled to as a lower level as possible.

The cradle member 8*c* has a recess 82 of a C-shape in cross-section provided in the lower side thereof for engagement with the table and wheels 72*c* of second transfer means 71*c*. This allows cradle member 8*c* to slide substantially in a fore and aft direction. Also, a shallow recess is provided at recess 82 in the lower side of cradle member 8*c* for accommodating second runway 81*c* which is made of an iron material and joined to cradle member 8*c* by tightening member 84 inserted from surface 83 side for traveling along and on transfer means 71*c*. As shown in FIG. 7C, eccentric bolts 73*c* are adjustably provided in recess 82 for preventing the leftward and rightward dislocation of cradle member 8*c* when running on transfer means 71*c*.

Alternatively, the dislocation of cradle member 8*c* when running on transfer means 71*c* may be prevented by the effect of guiding slots provided in both outer sides of runway 81*c* for guiding wheels 72*c* or of a step between runway 81*c* and recess 82. Runway (carriage) 81*c* and second transfer means 71*c* thus constitute linear transfer mechanism 7*c* (which may be of a portal-type or a monorail-type, the latter having no projections and permitting the upper space to be saved for any other application). Magnetic attraction force of transfer means 71*c* over runway 81*c* can be controlled by varying the surface area of magnetic material 75*c*, changing the diameter or the fixing-location of wheels 72*c*, or adjusting the distance between runway 81*c* and magnetic material 75*c*.

Runway 81*c* accommodated in recess 82 is secured to the lower side of cradle member 8*c* by tightening members 84 inserted from surface 83 side. When tightening members 84 are extended into recess 82, they can act as restricting means for second transfer means 71*c*. Also, lock pins may be provided for insertion into a row of lock holes 88 provided at equal intervals in cradle member 8*c* along runway 81*c*. As the lock pins extend, they lock up the sliding movement of cradle member 8*c*. Moreover, eccentric screws 73*c* for tightening wheels 72*c* maybe used as locking mechanisms. When eccentric screws 73*c* are turned to a specific angle, they drives wheels 72*c* downwardly until wheels 72*c* come indirect contact with runway 81*c*. Above described lock mechanisms may be replaced by a braking mechanism. The magnetic material of runways 21*c* and 81*c* may be selected from normal steel sheet, magnetic steel strip, electrical steel such as silicone steel, permalloy, and ferrite. High coercive magnetic members 35*c* and 75*c* may be selected from alnico magnet, ferrite magnet, and rare-earth permanent magnet such as samarium-cobalt magnet or neodymium magnet.

Transfer mechanisms 3*c* and 7*c* of a roller-type allow their corresponding transfer means 31*c* and 71*c* to travel with running wheels 32*c* and 72*c* on runways 21*c* and 81*c* respectively to transfer cradle member 8*c* while transfer means 31*c*, 71*c* and runways 21*c*, 81*c* are being held at their relative positions by the weight of the forearm of a user and the magnetic attraction of magnetic members 35*c* and 75*c* respectively. Transfer means 3*c* and 7*c* may be replaced with any other like means such as a slide-rail type mechanism or a non-contact type mechanism (air slider, linear motor).

In armrest 1*c* having cradle means 9*c* driven by a pair of linear transfer mechanisms 3*c* and 7*c* arranged slidable in two different directions, the forearm of a user mounted on cradle member 8*c* can smoothly be moved in all, leftward, rightward, forward, and backward, directions by the action of transfer means 31*c* and 71*c* with running wheels 32*c* and 72*c* while being supported from below by cradle means 9*c*. Also, as cradle means 9*c* and transfer means 31*c* are joined to base member 2*c* by the gravity of the forearm and magnetic attraction force between magnet 35*c* and runway 21*c*, cradle means 9*c* can easily be detached from platform 22*c* when simply lifted up by a force slightly greater than the magnetic attraction. Furthermore, as base member 2*c* is installed by detachable member 26 on surface 110 of a desk, it can be detached from the surface when softly pulled up.

The action of pivotal mechanism 5*c* is the same as pivotal mechanism 5*a* as shown in FIGS. 9A–9B and FIGS. 1B–1C.

Armrest apparatus 1*c* can be provided in the form of a kit. The kit hence comprises base member 2*c* arranged detachable directly to the surface of a desk, transfer means 31*c* mounted horizontally on base member 2*c* for traveling on wheels 32*c* along first runway 21*c*, joint member 5*c* pivotably mounted at one end on the interior of first transfer means 31*c*, support member 4*c* including rotatable thread mechanism 6*c* and transfer means 71*c*, cradle member 8*c* having second transfer mechanism 7*c* and runway 81*c* driven over transfer means 71*c*, anti-slip member 38 provided between support member 4*c* and transfer means 31*c*, and detachable member 26 for adhering to the bottom of detachable base member 2*c*, which all are packed in an appropriate package. Base member 2*c* in the kit can be separated into platform 22*c* and runway 21*c*. The support member 4*c* can be separated into first transfer means 31*c*, joint member 5*c*, and second transfer means 71*c*.

The procedure of assembling the components in the kit is as follows, picking out platform 22*c* from the kit, adhering detachable member 26 to the bottom of platform 22*c*, installing platform 22*c* on the surface of a desk, joining runway 21*c* by tightening members to platform 22*c*, mounting transfer means 31*c* on runway 21*c*, further mounting anti-slip member 38 on bottom 28 at the upper recess of transfer means 31*c*, mounting joint member 5*c* on anti-slip member 38, threading first transfer means 31*c* and cover 39*c* to each other, threading joint member 5*c* and second transfer means 71*c* to each other, and fitting cradle member 8*c* onto transfer means 71*c* on support member 4*c*. As a result, the assembly of armrest 1*c* is completed.

Figure 10A:
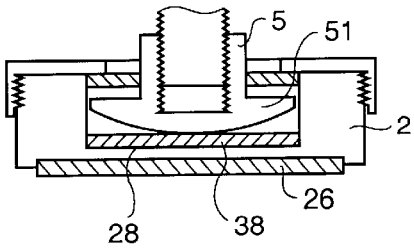
FIGS. 10A to 10F are sectional views illustrating some variations of the pivotal mechanism between the surface 28 of base member 22 and curved-surface 51 of joint member 5.
Figure 10D:
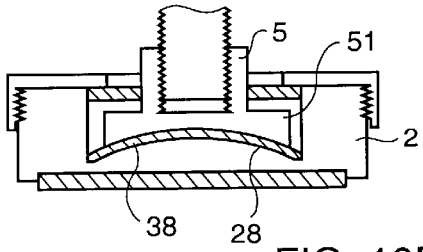
Figure 10B:
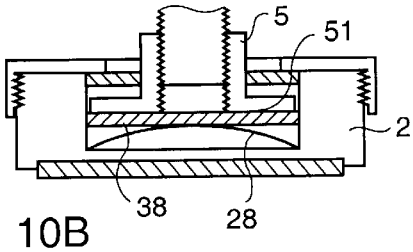
Figure 10E:
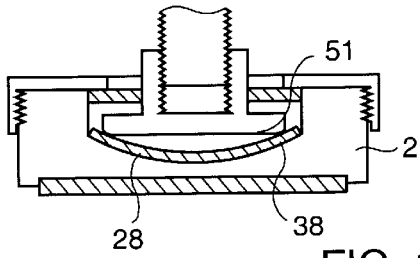
Figure 10C:
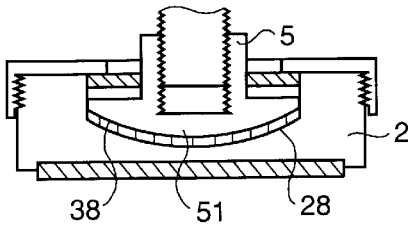
Figure 10F:
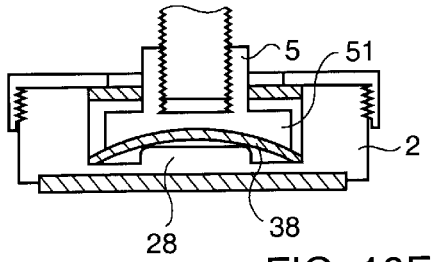

The combination between pivotably curved-surface 51 of joint member 5 and bottom-surface 28 at upper recess of platform 22/31 will now be explained, referring to FIG. 10. Shown in FIG. 10A is a combination between a convex curved-surface 51 of joint member 5 in cradle means 9 and a flat-plane 28 of platform 22 in base member 2. Shown in FIG. 10B is a combination between a flat-plane 51 of support member 4 and a convex curved-surface 28 of base member 2. Shown in FIG. 10C is a combination between a convex curved-surface 51 of joint member 5 and a concave curved-surface 28 of base member 2. Shown in FIG. 10D is a combination between a concave curved-surface 51 of joint member 5 and a convex curved-surface 28 of base member 2. Shown in FIG. 10E is a combination between a flat-plane 51 of support member 4 and a concave curved-surface 28 of base member 2. Shown in FIG. 10F is a combination between a concave curved-surface 51 of joint member 5 and a flat-plane 28 of base member 2.

The above six different modes of the combination can be used with equal success. The shape of curved-surface 51 shown in FIG. 10 is predetermined according to application, and it determines the pivotal motion of joint mechanism 5*a*. Thus, the forearm supported by cradle means 9*a* can be controlled according to the shape of curved-surface 51. The relation between the shape of curved-surface 51 and pivot motion of pivotal mechanism 5*a* is explained more detail as follows. Six different modes of the surface-combination permit from one to three rotational degrees of freedom (DOF) in pivot rotation.

First, the combination between joint member 5 and base member 2 for pivot motion in one rotational DOF may be implemented using a cylindrical curved-surface. FIGS. 11D to 11F related to FIG. 2 illustrate an armrest apparatus 1*j* according to the present invention where cradle 8*j* is engaged with base member 2*j*, and cradle member 8*j* is directly attached to joint member 5*j*. While like components are denoted by like numerals as those of the previous embodiment, joint member 5*j* is pivotably fitted in to a upper cylindrical-recess provided in base member 2*j*. As curved-surface 51 of joint member 5*j* is directly associated with bottom curved-surface 28 in the upper recess of base member 2*j*, anti-slipmember 38 is interposed in the pivotal space on bottom 28. In practice, the cylindrical form is positioned so that the forearm can pivotably be rotated in the forward and backward directions or its axis is arranged horizontally so that the forearm can pivotably be rotated crosswisely. When curved-surface 51 of the cylindrical form is determined for rotation along one axis, the combination between curved-surface 51 of support member 4*j* and surface 28 of platform 22*j* can be selected from six different modes shown in FIGS. 10A to 10F.

When two rotational DOFs are needed for pivot motion, two differently specified structures may be formed: one is a modified cylindrical form which is tapered up towards both ends, the other is a same-cylindrical form accompanied at top or inside with an extra member arranged rotatable about the second-axis joined by a thread mechanism or any appropriate means. For the pivot in two different DOF, the combination between curved-surface 51 and bottom 28 of platform 22 can be selected from six different modes shown in FIGS. 10A to 10F.

When three or more rotational DOFs are required for pivot motion, curved-surface 51 can preferably be implemented using a sphere, a semi-sphere, an ellipsoid of revolution, a body of revolution of two-dimensional curve, a curved body of revolution, a normal curvilinear body, a surface having a part of them, or a surface having at least a part of their combination. It is also possible to combine a member arranged pivotable in one or two rotational DOF with a member arranged pivotable for the rotation in the third rotational DOF. It is preferable for forming curved-surface 51 of pivot motion to use a part of a sphere or semi-sphere in view of the ease of the manufacturing, a comfortable operation, and a predictable controlling of the natural operation.

As described, the combination between curved-surface 51 and bottom 28 can be selected from six different modes shown in FIGS. 10A to 10F for pivot rotations in three rotational DOFs. In particular, pivotal mechanism 5 having a combination of the flat surface and the convex curved-surface shown FIGS. 10A and 10B is much simpler in the structure and may preferably be employed. Also, pivotal mechanism 5 in FIGS. 10A or 10B can easily be operated over a normal range of the pivot motion and translation motion, e.g. spinning and sliding of cradle member 8 on pressure sensitive adhesives (silicone gel) 38, as compared with a so-called ball-socket-joint motion shown in FIGS. 10C or 10D. The arrangements of a ball-socket type pivotal mechanism shown in FIGS. 10C and 10D may be implemented by rotor and stator of an electromagnetic motor or an ultrasonic motor. The movement of pivot-motor mechanism can thus be controlled by varying the position of motor revolution or the torque of revolution.

FIG. 9E related to FIGS. 6 and 10B illustrates another armrest apparatus 1*e* according to the present invention where armrest 1*e* comprises mostly a base member 2*e* arranged detachable to surface 110 of a desk and cradle means 9*e* mounted pivotably on base member 2*e*. While like components are denoted by like numerals as those of the previous embodiment, base member 2*e* consists mainly of a support member 4*e*, which is a combination of a platform 22*e*, a rotary thread 6*e*, and a pivotal (joint) member 5*e*, having a detachable structure where pivotal member 5*e* is threaded into a recess provided in rotatable member 6*e* which is a upper portion of platform 22*e* of support member 4*e*. Cradle means 9*e* consists only of cradle member 8*e* seated on an anti-slip member 38 and an engaging means 71*e* with a threaded cover 72*e* for mounting on the curved-surface of pivotal member 5*e*. As the curved-surface of pivotal member 5*e* is directly associated with bottom flat-surface 71*e* in a lower recess of cradle member 8*e*, support member 4*e* is included in base member 2*e* in FIG. 9E. The angular control mechanism of pivot 5*e* and rotary thread 6*e* is performed with the same way as in armrest 1*b*, and the pivotal movement may be restricted by restricting cover 72*e* which is detachably threaded with engaging means 71*e*.

Figure 10G:
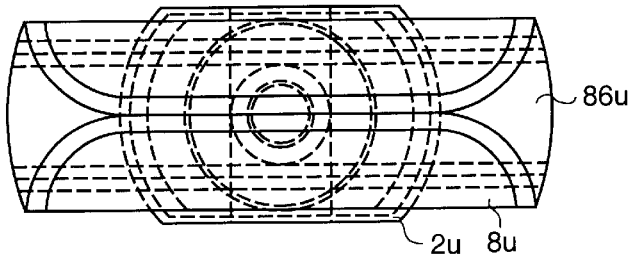
Figure 10H:
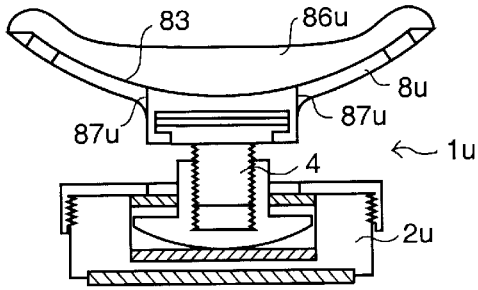
Figure 10J:
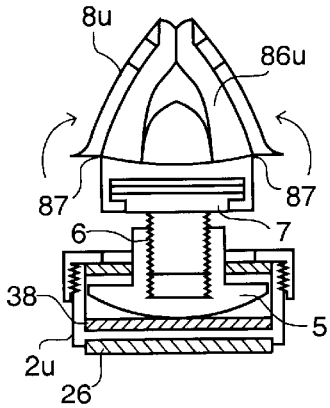

FIGS. 10G to 10J related to FIG. 2 illustrate a foldable armrest apparatus 1*u* according to the present invention where armrest 1*u* comprises mostly base member 2*u* arranged detachable to surface 110 of a desk and cradle means 9*u* mounted pivotably on base member 2*u*. While like components are denoted by like numerals as those of the previous embodiment, cradle means 9*u* consists mainly of support member 4 (which is a combination of pivotal mechanism 5, rotary thread 6, and an engaging means 7) and cradle member 8*u*, having a foldable structure where cradle member 8*u* is grooved at its lower surface into a narrow slit 87*u* which is a member of the foldable mechanism of cradle member 8*u*. FIG. 10H illustrates a normal cradle state for a mouse/keyboard user where a resilient cover sheet 86u is mounted on surface 83. FIGS. 10G and 10J illustrate a folded state of cradle 8*u* to be portable, where the wing members of cradle 8*u* are folded through slit 87*u* to upward.

FIGS. 11A to 11C related to FIG. 6 illustrate an armrest apparatus 1*d* according to the present invention which has a cradle member 8*d* arranged for 3-d pivot motion and joined with a slide-type transfer mechanism 7*d* along one direction. While the principles of the action of armrest 1*d* with the forearm mounted on cradle member 8*d* is identical to that of armrest 1*b*, the number of the major components is successfully decreased. The structure of armrest 1*d* will be described in more detail referring to FIG. 11. Armrest 1*d* comprises mainly base member 2*d* (anti-slip member 38 only) and a cradle means 9*d*. Cradle means 9*d* comprises an angular control mechanism and transfer mechanism 7*d* and cradle member 8*d*. The angular control mechanism in cradle means 9*d* consists mainly of pivotal mechanism 5*d* and rotary mechanism 6*d*. Base member 2*d* arranged detachable on surface 110 of a table incorporates anti-slip member 38 which also acts as detachable member 26 while platform 22 is not provided. The angular control mechanism including pivotal mechanism 5*d* and rotary mechanism 6*d* is mounted on anti-slip member 38.

A female thread is provided in the inner wall at a recess of joint member 5*d* for engagement with a male thread joined by welding to the lower side of slider (transfer table) 7*d* on a slide rail in transfer mechanism 7*d*, hence constituting rotary thread 6*d* for rotary movement. In addition, as transfer wheels (balls) 72*d* are provided for the sliding movement of a carrier (rail) 81. Cradle member 8*d* is secured to transfer mechanism 7*d* by tightening members inserted from surface 83 side. Accordingly, armrest 1*d* allows the forearm mounted on cradle member 8*d* to be arbitrarily controlled for pivotal motion by joint member 5*d* and rotary motion by thread 6*d* and translation by slider 7*d*.

Cradle member 8*d* shown in FIG. 11B may be made of three, left, right, and center bottom, wooden plates sheets (which preferably have a thickness of 5 to 25 mm and more preferably 7 to 15 mm) and provided in a kit form. This allows surface 83 to be friendly with the skin of the forearm. Also, surface 83 can easily be decorated (at its upper side and/or both sides and lower side) by carving when desired. It is a good idea that the separate wooden plates are decorated by carving, painted with lacquer or pigments, and then assembled together along their ribs and slots by adhesive to cradle member 8*d* of a desired design. Moreover, patterns or pictures, e.g. flowers or animals, selected by the user may be printed in advance on the three wooden plates for ease of the carving. Alternatively, with no use of rotary mechanism 6*d* and transfer mechanism 7*d* shown in FIG. 11, armrest 1*d* maybe composed of base member 2*d* of anti-slip member 38, pivotal member 5*d*, and cradle member 8*d*.

FIG. 12 related to FIGS. 6 and 11 illustrates armrest apparatus 1*v* made in a balloon form. Armrest 1*v* is basically similar in the structure to armrest 1*d* shown in FIG. 11B. Armrest 1*v* comprises a cradle means 9*v* only. Joint member 5*v*, support member 4*v*, and cradle member 8*v* are integrally formed with a balloon form into cradle means 9*a* from a thin, resilient material. Their chambers are separated from each other by partitions 3*v*. Partition 3*v* has a through opening 30 provided therein for passing a flow of air, water, or any other appropriate fluid. Referring to FIG. 12, a flow control means v1 having a needle member is connected at one end to a small pipe v10 below cradle member 8*v*. Needle member v2 having a fluid aperture opened at the distal end and a side aperture communicated by center channel is provided extending through flow control means v1. The near side of needle member v2 has an O-ring v3 mounted thereon and the distal end extends into small pipe v10.

Figure 12A:
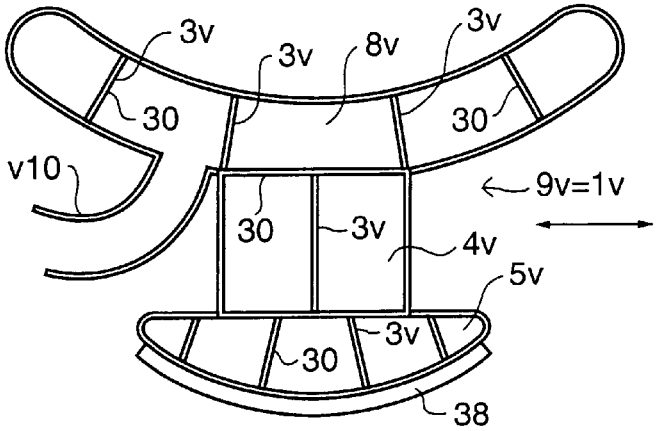
FIG. 12A is a sectional view of armrest 1*v* at a pressurized, expanded state.
Figure 12C:
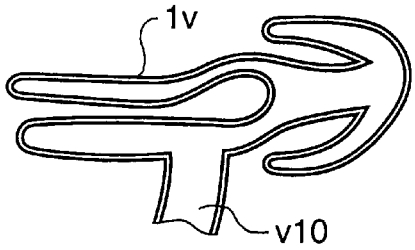
FIG. 12C is a sectional view of armrest 1*v* in a contracted state.
Figure 12B:
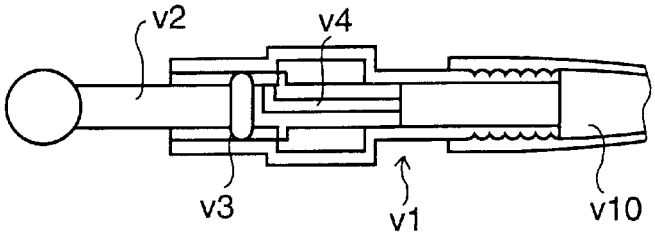
FIG. 12B is a sectional view of fluid control means v1 in service state.
Figure 12D:
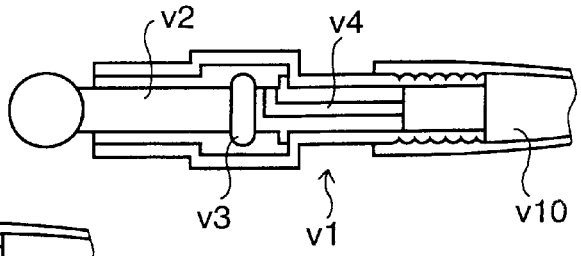
FIG. 12D is a sectional view of valve v1 not in use.

As best shown in FIG. 12D, needle member v2 is inserted into flow control means v1, allowing the fluid to be discharged out from the chambers in cradle means 9*v* and causing armrest 1*v* to stay at its contracted state (as shown in FIG. 12C) for ease of transportation. When armrest 1*v* is in service, needle member v2 is pushed into valve v1 (as shown in FIG. 12D) and a flow of fluid, such as compressed air, is introduced by blowing with the mouth into flow control means v1. As the chambers in cradle means 9*v* are filled through pipe v10 with the pressurized fluid (such as air), armrest 1*v* is turned to its expanded state as shown in FIG. 12A. When the pressure reaches at a desired level, needle member v2 is drawn out from flow control means v1 (as shown in FIG. 12B) so as to hold armrest 1*v* at the expanded state. Then, anti-slip materials 38 and/or 26 are bonded to the lower side of joint member 5*v* and the installation of armrest 1*v* is completed. When armrest 1*v* is not in use, it can be exhausted and folded down to a compact size thus becoming highly portable. In FIG. 12, flow control means v1 and pipe v10 are shown as very enlarged forms to explain the structures of them very exactly.

FIG. 13 related to FIG. 1B illustrates a modification where detachable member 26 is replaced by a vacuum suction type detachable member 20*v*. Base member 2*v* comprises vacuum suction bed 20*v* and platform 22*v* which are fitted with each other in this order. Vacuum suction bed 20*v* has a plurality of downwardly open recesses v30 (four recesses are shown in FIG. 13A) provided in the lower side thereof. Each of recesses v30 is communicated with a notch v32 having a gap v31 for passing a sheet. A vacuum suction disk v20 made of a resilient material such as plastic, urethane rubber, or gel material is fitted by adhesion, bonding, or screwing into recess v30. Vacuum suction disk v20 has a projection tab v22 provided on the upper side thereof. As projection tab v22 extends out from gap v31 and notch v32 in vacuum suction bed 20*v*, it can be picked up by hand. Vacuum suction bed 20*v* is made of an elastic material and preferably minimized in the thickness so that it can be deformed when urged from above by the cradle member not shown. As two or more of vacuum suction disks v20 are distributed at distance, platform 22*v* remains secured by the remaining of vacuum suction disks v20 if one of them is malfunctioned.

Figure 13A:
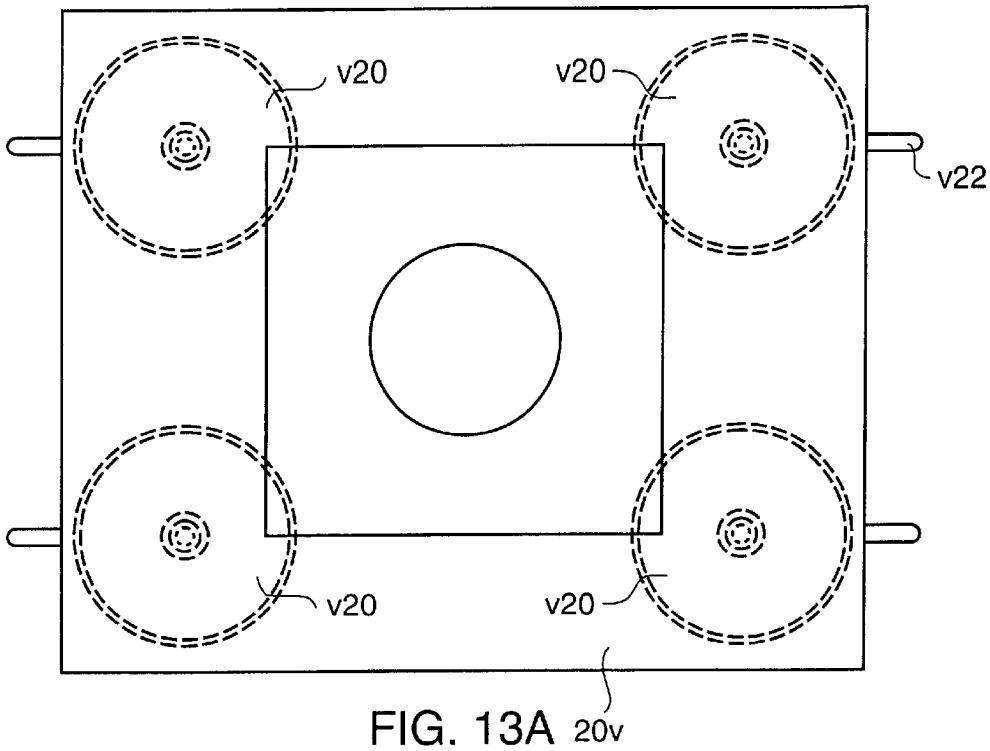
FIG. 13A is a plan view of the same.
Figure 13B:
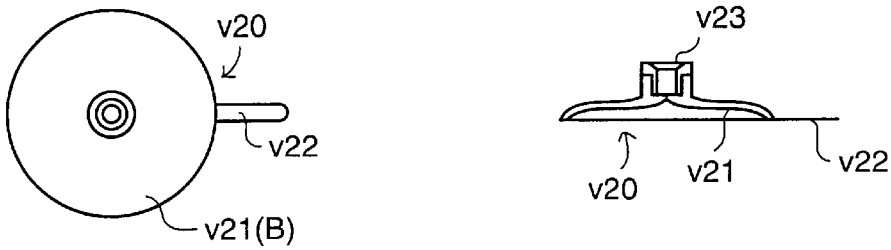
FIG. 13B is a plan view and a side view of a suction plate.
Figure 13C:
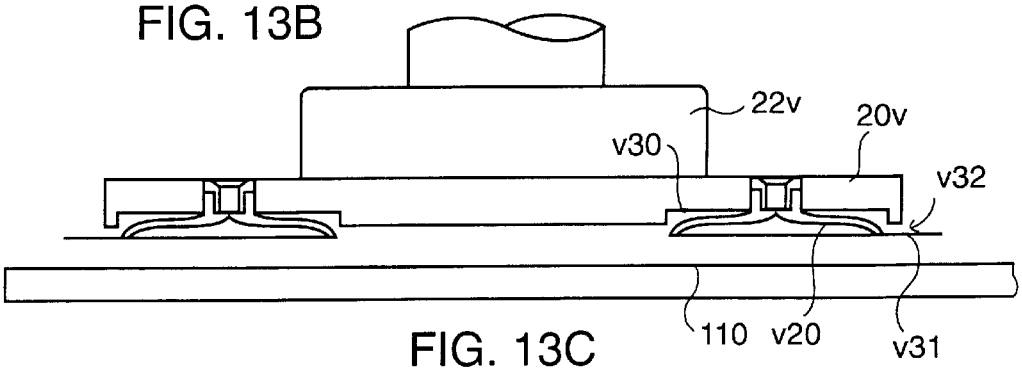
FIG. 13C is a side view of detachable member 20*v* before the suction process.
Figure 13D:
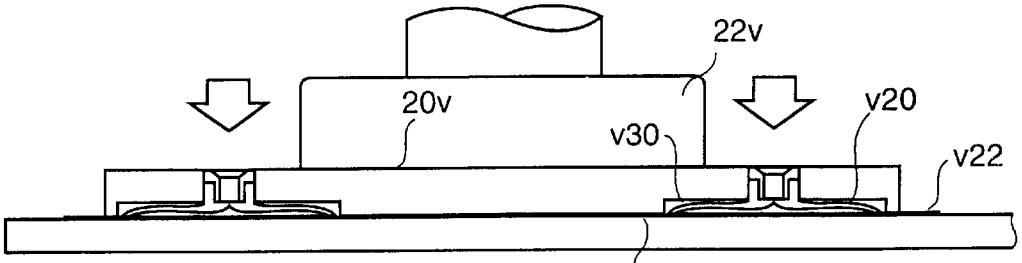
FIG. 13D is a side view of detachable member 20*v* after the suction process.

In action, when vacuum suction disks v20 are urged above vacuum suction bed 20*v* by a pressure from the cradle means not shown, they are pressed down to discharge the air from their interior, thus holding platform 22*v* securely on surface 110 of a desk as shown in FIG. 13D. When projection tabs v22 are pulled up by hand, they allows the air to move into the interior of vacuum suction disks v20. As all vacuum suction disks v20 are liberated, base member 2*v* can easily be dismounted from surface 110 of the desk.

FIG. 14 illustrates a resources-saving type desk-system sys1 where armrest 1*a* can be mounted and dismounted from the near side of a desk, also a display and a keyboard are mounted on each height control means 400 respectively. Desk-system sys1 is installed as follows. First a plurality of a detachable member w26 (preferably a double-sided adhesive tape having a sheet coated at both sides with a highly pressure sensitive adhesive material) are bonded at predetermined locations on the surface 110 of a table or desk (M1). A plurality of a retaining member w2 and/or spacer w2 (which is preferably smaller than 12 mm in the thickness, more preferably not greater than 6 mm) are mounted on each detachable member w26 (M2). A plurality of detachable member w26 (which is the same size of step M1) are bonded on the top surface of each retaining member w2 and/or spacer w2 (M3) in FIG. 14C. As shown in FIG. 14A, a thin flat-face plate w1 (which is preferably smaller than 12 mm in the thickness, more preferably not greater than 3 mm) is layered on detachable member w26 (in step M3) to be fixed to retaining members (M4).

Under a keyboard at the front side, retaining member w2 having a group of at least two recesses w3 provided in the front side thereof for accepting an upper portion w5 of a hook-like thin plate w4 is preferably interposed between flat-face plate w1 and surface 110 of a desk. Recesses w3 (which is preferably smaller than 6 mm in the thickness, more preferably not greater than 3 mm) are provided at least one or more for each retaining member w2.

The hook-like thin plate w4 (which is preferably smaller than 6 mm in the thickness, more preferably not greater than 3 mm) has a lower portion w6 (which is preferably not lower in the height of the lowest bottom face than a drawer 111 of the desk in FIGS. 14E or 14G) thereof arranged for supporting armrest 1*a* or 1*b* in FIG. 14B. While armrest 1*a* or 1*b* is installed not directly on surface 110 of the desk, it can be mounted on lower portion w6 of thin plate w4 (in FIGS. 14E or 14F) which in turn engages through upper portion w5 with recess w3 in retaining member w2 in FIGS. 14G or 14H. This eliminates the mounting and dismounting of detachable member 26 adhered to the lower side of base member 2*a* or 2*b*, thus permitting a one-touch action for installation of armrest 1*a* or 1*b*. As shown in FIG. 14G, preferably pin w8 is pushed into hole w9 for preventing thin plate w4 slipping from recess w3 when in service. This effect is also obtained by forming draft angle between upper portion w5 and recess w3, and interposing thin wedge (not shown) in it. When thin plate w4 is made of a CFRP or titanium, it can be reduced in the weight with its physical strength staying enough to stand for body weight of user.

When thin plate w4 is increased in the length crosswisely of the desk but within a given range, the distance between two armrest apparatus can favorably be adjusted corresponding to the shoulder span of each user. Also, as surface 110 of the desk is free from armrest assemblies, it can be used for any other application. For example, a keyboard may be located at the front edge of thin plate w1 in FIG. 14B or 14G. When retaining member w2 for holding a side table w10 is provided (similar to retaining member w2 for holding thin plate w4) beneath thin plate w1, an extra job can be conducted on side table w10 supported by leg w11 in FIG. 14A. Accordingly, any type of computer-dedicated table will be eliminated and the given space for PC operation in an office may be used at efficiency.

A modification of the embodiment of the present invention may be provided, as shown in FIG. 14D, where a height control means 400 comprises detachable member 38*a* and base member 401 and moving bed 404. Base member 401 is adhered at lower side by detachable member 38*a*, and formed at upper side by recess 402 at least one or more. In a side face of recess 402, tooth row 403 is formed at a given pitch. While for moving bed 404, projection 405 is formed at lower side so that recess 402 can be accepted, and tooth row 408 is formed at outer side face of projection 405 according to tooth row 403. Further at projection 405, recess 406 is formed from upper side, and plunger 407 is engaged with recess 406. A height control method includes following steps, pulling out plunger 407 from recess 406 (H1), shifting the height of moving bed 404 at a desired position (H2), pushing plunger 407 into recess 406 so that tooth row 408 and 403 are not moving slidably with each other (H3), the height adjusting method of means 400 is completed.

FIG. 15 illustrates an armrest apparatus 1*k* according to the present invention where a cradle member 8*k* is covered at a contact surface 83 with a mat (and/or a permeable material) on which a plurality of needle members 12 are implanted (or mounted) and an external driven rocking mechanism 16 is provided in parallel. Armrest 1*k* is basically similar in the structure to that shown in FIG. 2 and comprises a base member 2*k*, a joint member 5*k*, a rotary mechanism 6*k*, a transfer mechanism 7*k*, and a cradle member 8*k* which are joined in this order. Pivotal mechanism 5*k*, rotary mechanism 6*k*, and transfer mechanism 7*k* constitute a support member 4*k*. Support member 4*k* and cradle member 8*k* constitute a cradle means 9*k*.

The arrangement of armrest 1*k* of this embodiment will now be described in more detail referring to FIG. 15. Armrest 1*k* comprises mostly base member 2*k* and cradle means 9*k*. Cradle means 9*k* is composed of support member 4*k* (including pivotal mechanism 5*k*, rotary mechanism 6*k*, and transfer mechanism 7*k*) and cradle member 8*k*. Base member 2*k* and support member 4*k* are joined to each other by pivotal mechanism 5*k*. Also, support member 4*k* and cradle member 8*k* are joined to each other by transfer mechanism 7*k*. Accordingly, as the forearm of a user mounted on cradle member 8*k* is held in the air from below for the pivotal movement, its location and angular attitude can arbitrarily be controlled by the user in any desired motion.

The structure of base member 2*k* arranged detachable will be explained in more detail. Base member 2*k* shown in FIG. 15 comprises a platform 22*k* having a recess provided in the upper side thereof for pivotal mechanism 5*k* of a rotary-slide type and a detachable member 26 joined detachably to the lower side of platform 22*k*. A cover 29*k* having a dust-proof function and acting as a holder of joint member 5*k* is engaged through threading with base member 2*k*. In armrest 1*k*, joint member 5*k* has a relatively small radius r and supported across cover 29*k* in the upper recess of platform 22*k*. While joint member 5*k* acts as a rotary-slide mechanism for the pivotal movement, the thread mechanism permits platform 22*k* and cover 29*k* to be detachably joined to each other. Also, the pivotal movement of the rotary-slide mechanism can be controlled by the clamping force of thread mechanism on joint member 5*k*. The pivotal movement between joint member 5*k* and the bearing surface of platform 22*k* may favorably be controlled by the effect of a thread means consisting of a series of adjusting slots provided in a bearing surface at the upper recess of platform 22*k*.

When the bearing surface of platform 22*k* is made of a harder material than that of joint member 5*k* and has a radius slightly smaller than that of joint member 5*k*, the operating life of the pivotal mechanism will increase. For example, when the bearing surface is made of a hard synthetic rubber material and joint member 5*k* is made of a synthetic resin material, the operating life becomes longer than that with both the bearing surface and joint member 5*k* made of the synthetic resin material. It is also possible to have the bearing surface shaped of a convex form of a sphere and joint member 5*k* shaped of a concave form as shown in FIG. 1D. Alternatively, the bearing surface is made of a magnetic material such as a rare-earth magnet while joint member 5*k* is made of a steel ball.

Support member 4*k* shown in FIG. 15 includes joint member 5*k*, thread mechanism 6*k* also acting as a rotary mechanism, and a guide table 71*k*. Support member 4*k* is detachably joined to cradle member 8*k* by transfer mechanism 7*k*. More particularly, joint member 5*k* of support member 4*k* is pressed at curved-surface 51 into the upper recess of platform 22*k*. As support member 4*k* and base member 2*k* are joined by pivotal mechanism 5*k*, joint member 5*k* has a cylindrical recess provided in the upper side thereof. A female thread is provided at the cylindrical recess in joint member 5*k* for thread engagement with a male recess provided in the lower end of guide table 71*k*, thus constituting thread mechanism 6*k*. Thread mechanism 6*k* serves as a rotary mechanism for turning joint member 5*k* relative to cradle member 8*k* and a height control mechanism for adjusting the height of surface 83 of cradle member 8*k*.

Figure 15A:
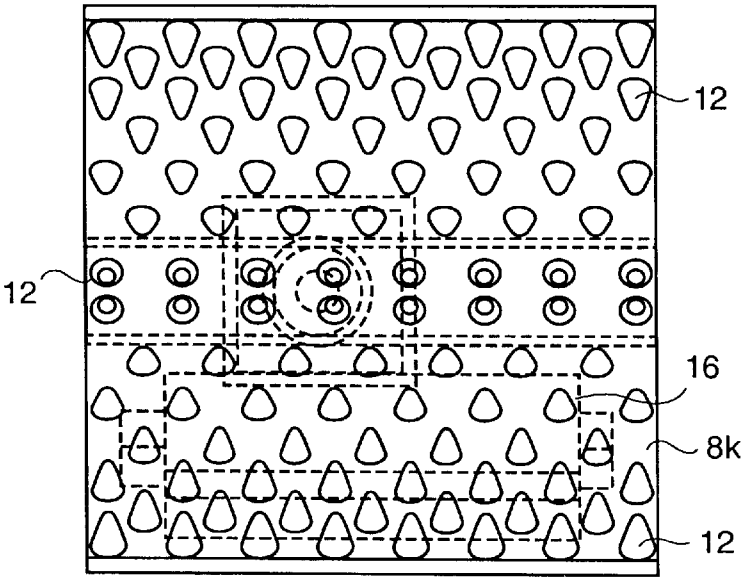
FIG. 15A is a plan view of armrest 1*k*.
Figure 15B:
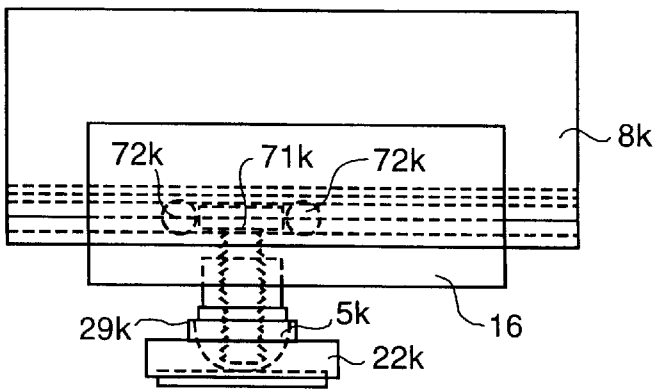
FIGS. 15B and 15C are a side view and a front view of the same.

Support member 4*k* and cradle member 8*k* of this embodiment are similar to support member 4*b* and cradle member 8*b* shown in FIG. 6. Surface 83 of cradle means 8*k* is arranged of an arch shape in the cross-section for giving a level of stability when supporting the forearm of a user. Also, as shown in FIG. 15A, surface 83 is covered with a mat (of permeable materials such as sponge or porous materials, synthetic rubbers such as urethane rubbers, artificial leathers, natural fabric, porous metals, or a combination thereof) which is adhered by a detachable member 13 and on which a group and/or rows of needle-like members 12 are implanted. This allows the forearm mounted on surface 83 to be favorably massaged under its weight. Surface 83 of cradle member 8*k* may be covered with a stretchable supporter, fabric, or arm band which are adhered by a detachable member as not shown for identification of armrest 1*k* without being lost. This effect maybe implemented by a magic tape adhered on surface 83. Moreover, it is desirable to construct surface 83 and/or armrest 1*k* with anti-bacterial, deodorant materials.

When surface 83 of cradle member 8*k* is made of a flexible or elastic material, it can more or less absorb any unwanted force exerted from the forearm of a user. Also, needle-like member 12 on the mat may preferably be made of flexible and/or elastic materials for safety. Surface 83, cradle member 8*k*, support member 4*k*, and/or base member 2*k* may be accompanied (or provided) in armrest 1*k* with permanent magnets for promotion of blood flows, a heating means such as a heater or a far-infrared ray emitter for speeding the blood flows, biological sensors such as a pulse meter, a thermometer, and a blood pressure meter for checking the conditions of the user, and a radio ID tag for radio transmission of the sensor data and identification of the user/safety, or a combination thereof.

Figure 15C:
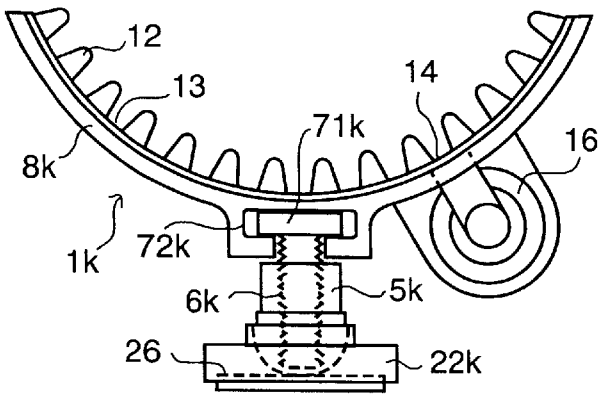
Figure 15D:
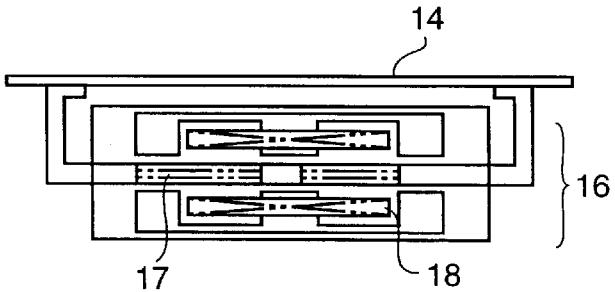
FIG. 15D is a sectional view of rocking mechanism 16.

As shown in FIGS. 15C and 15D, externally driven rocking mechanism 16, such as an eccentric motor or a rocking solenoid, (which comprises a magnet 17 and a coil 18 supplied with e.g. an AC current) is embedded or mounted to the lower side of cradle member 8*k* or the interior of support member 4*k*. Upon receiving a switching current from a power supply such as a battery, externally driven rocking mechanism 16 performs a massaging action for the forearm mounted on cradle member 8*k*. This action is particularly effective when the operation of the hand is continuously conducted for a long period of time. Rocking mechanism 16 may be implemented by a motor driven mechanism having an eccentric load embedded or mounted on a normal motor shaft or an ultra sonic vibrator mechanism. The motor employed maybe driven by AC or DC current. The DC motor may be selected from normal brush motors and permanent magnetic type brush-less motors. Rocking mechanism 16 may be fed with driving energy from base member 2*k* over a wireless electromagnetic induction or photoelectric system. Also, an ultrasonic vibrator mechanism using an ultrasonic motor may be used with equal success. When cradle member 8*k* has the ultrasonic vibrator mechanism embedded or mounted to the lower side thereof, their combination can be a single, compact rocking or vibrating system.

It is also possible to have coils embedded in base member 2*k* or support member 4*k* for feeding rocking mechanism 16 or the power supply with driving energy over a wireless electromagnetic inducting means. Alternatively, the wireless transmission of driving energy may be replaced by a pair of a light emitting device and a photoelectric device. More simply, externally driven rocking mechanism 16 may be energized from a power line. For readily discharging the static electricity developed on the user, base member 2*k*, support member 4*k*, and/or cradle member 8*k* may be constructed by or assorted with an electrically conductive material such as CFRP. It is also a good idea for improving the safety and sanitary that armrest 1*k* is subjected to anti-bacterial or deodorant treatment.

The pivotal mechanism in each armrest of the present invention is most preferable but not limited to the system shown in FIGS. 2 and 6. A similar or like arrangement of pivotal mechanism may equally be employed. FIG. 16 illustrates an armrest apparatus 1*h* according to the present invention where a cradle means 9*h* includes a slidable (transfer) mechanism 7*h* arranged for rocking movements in all, upward, downward, leftward, and rightward, directions and linear movement along one direction. While like components are denoted by like numerals as those explained previously, pivotal mechanism 5*b* in armrest 1*b* shown in FIG. 6 is replaced by a rocking mechanism 5*h* mounted on a base member 2*h*. This allows armrest 1*h* to be controlled for the rocking movements and the sliding movement. While cradle means 9*h* is joined with base member 2*h*, it is composed of rocking mechanism 5*h*, transfer mechanism 7*h*, and cradle member 8*h*. An angular control mechanism of cradle member 8*h* is formed by only rocking mechanism 5*h*, which comprises an elastic materials, such as a coil spring, and enables elastic-rotary motion about yaw-axis and pitch-axis, but this rotary motion is not clearly controlled by user compared with pivotal mechanism, and accompanied with irregular locational displacements.

Support member 4*h* mainly comprises elastic member 5*h*, joined at one end to a platform 22*h* for supporting cradle member 8*h* for rocking movements while a detachable member 26 of preferably a pressure sensitive adhesive is adhered to the lower side of platform 22*h* for detachable installation on the surface of a desk. Also, a height control chain 66*h* for adjusting the height of cradle member 8*h* is accommodated at one end in a recess provided in the upper side of platform 22*h* (between platform 22*h* and cradle member 8*h* as shown). More specifically, chain 66*h* is joined at both ends with limiting strips 67*h*, which each has such a through opening as shown in FIGS. 16D and 16E, so as to extend between the recess of platform 22*h* and a guide table 71*h* of cradle member 8*h* as shown in FIGS. 16B and 16F for adjusting the height of cradle member 8*h*.

The other end of elastic member 5*h* is joined to guide table 71*b* beneath cradle member 8*h*. Guide table 71*h* and transfer wheels 72*h* (rotatably mounted to guide table 71*h*) are accepted in a recess 82 of a C shape in the cross-section provided in the lower side of cradle member 8*h*, thus constituting linear transfer mechanism 7*h* for allowing cradle member 8*h* to travel substantially in a fore and aft directions.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. An armrest apparatus comprising:

a base member mounted on the surface of a table or desk;

a cradle means supporting for an elbow-side portion of a forearm from the wrist; and said base member and said cradle means further including a pivotal mechanism formed by freely mounting a convex curved-surface of said cradle means on a flat-plane of said base member; and an anti-slip member interposed between said base member and said cradle means in order to ensure a fluidity level of the follow-up capability to the movements of the forearm.

2. The apparatus claimed in claim 1, wherein said armrest includes an external driven rocking mechanism.

3. The apparatus claimed in claim 1, wherein said armrest is accompanied with permanent magnet, a heating means, biological sensors, a pulse meter, a thermometer, a blood pressure meter, and a radio ID tag, or combinations thereof.

4. The apparatus claimed in claim 1, wherein said anti-slip member includes adhesive materials, pressure sensitive adhesives, plastics, synthetic resins, resilient materials, rubber adhesive materials containing natural or synthetic rubbers, acrylic adhesive materials made by copolymerization of acrylic acid ester and functional monomer, polyether/polyurethane adhesive materials, natural resins such as birdlime, and gel materials such as silicone gel or porous silicone gel, or combinations thereof.

5. The apparatus claimed in claim 1, wherein said pivotably curved-surface includes a sphere, a semi-sphere, an ellipsoid of revolution, a body of revolution of two-dimensional curve, a curved body of revolution, a normal curvilinear body, a cylinder, or a surface having at least a part of their combinations.

6. The apparatus claimed in claim 1, wherein said base member and said cradle means are detachable.

7. The apparatus claimed in claim 1, further comprising a height control means of said cradle means.

8. The apparatus claimed in claim 1, further comprising a restricting means for restricting the pivotable range of said cradle means.

9. The apparatus claimed in claim 1, wherein a driving force for the pivotal movements between said cradle means and said base member is adjustable by said anti-slip member.

10. The apparatus claimed in claim 1, wherein a detachable member is attached to the bottom of said base member.

11. The apparatus claimed in claim 10, wherein said detachable member includes urethane rubbers, a vacuum suction member, a magnetic material, adhesive materials, pressure sensitive adhesives, plastics, synthetic resins, resilient materials, rubber adhesive materials containing natural or synthetic rubbers, acrylic adhesive materials made by copolymerization of acrylic acid ester and functional monomer, polyether/polyurethane adhesive materials, natural resins such as birdlime, and gel materials such as silicone gel or porous silicone gel, or combinations thereof.

12. The apparatus claimed in claim 1, wherein said base member comprises a platform, a cover, and a detachable member.

13. The apparatus claimed in claim 12, wherein said cover comprises a restricting means for restricting the pivotable range of said cradle means.

14. The apparatus claimed in claim 12, wherein a second anti-slip material, an annular elastic material, a gel material, or a combination of them are interposed between said cover and said cradle means.

15. The apparatus claimed in claim 1, wherein said cradle means comprises a support member and a cradle member.

16. The apparatus claimed in claim 15, wherein said support member comprises a joint member and a post member.

17. The apparatus claimed in claim 15, wherein said cradle member and said joint member are rotatably connected with each other.

18. The apparatus claimed in claim 15, wherein the length of said support member is adjustable.

19. The apparatus claimed in claim 15, wherein said cradle member is covered at a contact surface with a plurality of needle members, permeable materials such as sponge or porous materials, synthetic rubbers such as urethane rubbers, artificial leathers, natural fabric, porous metals, or combinations thereof.

20. A method for installing an armrest apparatus on a surface of a desk, said armrest apparatus including a base member and a cradle means supporting for an elbow-side portion of a forearm from the wrist, the steps of the method comprising:

forming a pivotal mechanism by freely mounting a convex curved-surface of said cradle means on a flat-plane of said base member;

interposing an anti-slip member between said base member and said cradle means in order to ensure a fluidity level of the follow-up capability to the movements of the forearm.

21. The method claimed in claim 20, wherein said anti-slip member includes adhesive materials, pressure sensitive adhesives, plastics, synthetic resins, resilient materials, rubber adhesive materials containing natural or synthetic rubbers, acrylic adhesive materials made by copolymerization of acrylic acid ester and functional monomer, polyether/polyurethane adhesive materials, natural resins such as birdlime, and gel materials such as silicone gel or porous silicone gel, or combinations thereof.

22. The method claimed in claim 20, wherein said pivotal mechanism includes a pivotably curved-surface selected from the group consisting of a sphere, a semi-sphere, an ellipsoid of revolution, a body of revolution of two-dimensional curve, a curved body of revolution, a normal curvilinear body, a cylinder, or a surface having at least a part of their combinations.

23. The method claimed in claim 20, comprising the additional step of controlling a height of said cradle means.

24. The method claimed in claim 20, comprising the additional step of restricting the pivotable range of said cradle means.

25. The method claimed in claim 20, comprising the additional step of adjusting a driving force for the pivotal movements between said cradle means and said base member by said anti-slip member.

26. The method claimed in claim 20, comprising the additional step of attaching a detachable member to the bottom of said base member.

27. The method claimed in claim 20, wherein said base member comprises a platform, a cover, and a detachable member.

28. The method claimed in claim 20, wherein said armrest is accompanied with permanent magnet, a heating means, biological sensors, a pulse meter, a thermometer, a blood pressure meter, and a radio ID tag, or combinations thereof.

29. The method claimed in claim 20, wherein said armrest includes an external driven rocking mechanism.

30. The method claimed in claim 20, wherein said cradle means comprises a support member and a cradle member.

31. The method claimed in claim 30, wherein said support member comprises a joint member and a post member.

32. The method claimed in claim 30, wherein said cradle member is covered at a contact surface with a plurality of needle members, permeable materials such as sponge or porous materials, synthetic rubbers such as urethane rubbers, artificial leathers, natural fabric, porous metals, or combinations thereof.

* * * * *